US006367362B1

(12) United States Patent
Brazell et al.

(10) Patent No.: US 6,367,362 B1
(45) Date of Patent: Apr. 9, 2002

(54) APPARATUS FOR PUNCHING STEEL STUDS

(75) Inventors: Kenneth M. Brazell, Phoenix, AZ (US); John E. Nemazi, Bloomfield Hills, MI (US); Akio Takamura, Phoenix, AZ (US); Masatoshi Fukinuki, Fuchu (JP); Jeffrey M. Dils; Robert G. Everts, both of Chandler, AZ (US)

(73) Assignee: Ryobi North America, Inc., Anderson, SC (US)

( * ) Notice: Subject to any disclaimer, the term of this patent is extended or adjusted under 35 U.S.C. 154(b) by 0 days.

(21) Appl. No.: 09/380,010

(22) PCT Filed: Feb. 16, 1999

(86) PCT No.: PCT/US99/03244

§ 371 Date: Aug. 23, 1999

§ 102(e) Date: Aug. 23, 1999

(87) PCT Pub. No.: WO99/41046

PCT Pub. Date: Aug. 19, 1999

Related U.S. Application Data

(63) Continuation of application No. 09/025,284, filed on Feb. 16, 1998, now abandoned.

(51) Int. Cl.[7] ..... B26D 9/00

(52) U.S. Cl. ..... 83/518; 83/590; 83/613; 83/628; 83/686

(58) Field of Search ..... 83/518, 628, 590, 83/686, 613

(56) References Cited

U.S. PATENT DOCUMENTS

| | | | | |
|---|---|---|---|---|
| 503,109 A | | 8/1893 | Davis et al. | |
| 1,343,872 A | | 6/1920 | Livering | |
| 1,354,517 A | | 10/1920 | Sollazzo | |
| 2,360,111 A | | 10/1944 | Dedona | |
| 2,765,019 A | | 10/1956 | Evans | |
| 2,865,451 A | | 12/1958 | Ihrig | |
| 2,874,666 A | | 2/1959 | Thor | |
| 3,387,525 A | | 6/1968 | Funke | |
| 3,395,724 A | | 8/1968 | Hamel | |
| 3,422,750 A | | 1/1969 | Anderson | |
| 3,496,967 A | | 2/1970 | Timmerbeil | |
| 3,541,685 A | | 11/1970 | Gizdich | |
| 3,800,419 A | | 4/1974 | Hughes, Jr. | |
| 3,863,341 A | | 2/1975 | Ramer | |
| 3,877,280 A | | 4/1975 | Cornell | |
| 3,925,875 A | | 12/1975 | Doke | |
| 3,939,563 A | | 2/1976 | Deike | |
| 3,987,695 A | * | 10/1976 | Neilsen | 83/628 |

(List continued on next page.)

FOREIGN PATENT DOCUMENTS

| | | |
|---|---|---|
| DE | 455 193 | 2/1926 |
| DE | 538368 | 10/1931 |
| FR | 556553 | 2/1960 |

*Primary Examiner*—M. Rachuba
(74) *Attorney, Agent, or Firm*—Brooks & Kushman P.C.

(57) ABSTRACT

An apparatus for punching knock-outs out of light gauge steel framing studs used in building construction to form holes of sufficient size to allow building wiring and piping to extend therethrough includes a compact hand held frame (12) having a generally C-shaped frame portion (14). The C-shaped frame portion has spaced apart ends (16, 18) located along a working axis (20) for receiving a stud (30) therebetween. A punch and die assembly (24) includes a punch (26) and a die (28) mounted opposite each other at the ends of the C-shaped frame portion. An actuatable driving mechanism (36) mounted to the frame is operable to drive the punch and dic assembly over a working stroke range between a deactuated position (52) and an actuated position (54). In the actuated position, the punch extends into the die by punching through the stud to produce a knock-out (342).

24 Claims, 16 Drawing Sheets

U.S. PATENT DOCUMENTS

| | | | | | |
|---|---|---|---|---|---|
| 4,201,130 | A | | 5/1980 | Stahl | |
| 4,329,867 | A | | 5/1982 | Nelson | |
| 4,571,975 | A | | 2/1986 | Pawloski et al. | |
| RE32,460 | E | | 7/1987 | Leggett, Jr. | |
| 4,707,924 | A | | 11/1987 | Burney | |
| 4,773,325 | A | | 9/1988 | Shiokawa et al. | |
| 4,826,561 | A | * | 5/1989 | Carroll | 83/140 |
| 4,878,374 | A | | 11/1989 | Nelson | |
| 4,899,447 | A | | 2/1990 | Adleman | |
| 4,905,557 | A | | 3/1990 | Adleman | |
| 4,987,811 | A | | 1/1991 | Ikarashi et al. | |
| 5,142,958 | A | | 9/1992 | Nordlin et al. | |
| 5,282,303 | A | | 2/1994 | Schriever | |
| 5,287,716 | A | | 2/1994 | Szule | |
| 5,416,975 | A | | 5/1995 | Saito et al. | |
| 5,425,262 | A | | 6/1995 | Dubugnon | |
| 5,598,635 | A | | 2/1997 | Saito | |
| 5,697,278 | A | | 12/1997 | Shun-Yi | |
| 5,867,909 | A | | 2/1999 | Jeltsch et al. | |

* cited by examiner

APPARATUS FOR PUNCHING STEEL STUDS

CROSS-REFERENCE TO RELATED APPLICATION

This application is a national stage of PCT/US99/03244, filed on Feb. 16, 1999, and a continuation-in-part of U.S. application Ser. No. 09/025,284 filed on Feb. 16, 1998, now abandoned.

TECHNICAL FIELD

The present invention relates to an apparatus for punching steel studs to form holes of sufficient size to allow wiring and piping to extend therethrough, and sufficiently lacking sharp tongues or flanges that would damage the wiring or piping.

BACKGROUND ART

Steel frame homes and structures are becoming widespread. Steel frames have many advantages over traditional wooden frames. Steel frames are termite, rust, and rot proof. Further, steel frames are non-combustible, energy efficient, and resistant to poor weather and active seismic conditions.

Steel framing is made from light gauge galvanized steel cold formed into C-shaped cross-section components. Design changes are minimized by choosing components that match lumber dimensions, particularly when converting a wooden frame design to a steel frame design. Studs come in all sizes; however, most builders use 3⅝ inch and 5½ inch sizes that match wood frame dimensions.

When building steel frame homes and structures, it is necessary to have holes punched in the studs. These punched holes, sometimes called knock-outs, accommodate plumbing and electrical wiring by allowing pipes and/or wires to run through the holes. Steel studs may be purchased with preformed holes. Many times, the preformed holes are not in the desired locations, or there are no preformed holes. In these situations, the builder must form the holes in the steel stud wherever the holes are needed.

One way to form these holes is to use an acetylene torch to cut the holes. Using an acetylene torch to cut holes in steel studs is inconvenient for a builder. Another way to form holes in steel studs is with a large mechanical lever type piercer and die tool, such as that described in U.S. Pat. No. 5,287,716 issued to Szulc. Because a builder may not realize where it is desired to form holes in the steel studs until the frame is at least partially constructed, forming the holes is difficult. Many times, it is not possible to position the large lever type tool about the steel frame to form the holes because of the large size of the lever type tool, and because of the space constraints of the partially constructed frame. Further, sometimes it is difficult to align the holes on adjacent studs such that piping may be routed therethrough without additional difficulties. Still further, smaller lever type tools are generally only useful for forming small holes such as screw holes, and are not designed to form holes sized for wiring and/or piping.

SUMMARY OF THE INVENTION

It is, therefore, an object of the present invention to provide a compact hand held apparatus for punching steel studs.

In carrying out the above object, an apparatus for punching knock-outs out of light gauge steel framing studs used in building construction to form holes of sufficient size to allow building wiring and piping to extend therethrough is provided. The apparatus comprises a compact hand held frame having a generally C-shaped portion with spaced apart ends located along a working axis, and a handle for gripping by a user. A punch and die assembly includes a punch and a die mounted opposite each other at the ends of the C-shaped frame portion. The punch and the die are mounted for movement relative to each other along the working axis. An actuatable driving mechanism is mounted to the frame. The driving mechanism is operable to drive the punch and die assembly over a working stroke range between a deactuated and an actuated position. In the deactuated position, the punch and the die are spaced apart with the stud positioned therebetween. In the actuated position, the punch extends into the die cavity by punching through the stud to form the punched hole.

In a preferred embodiment, the working stroke range is not significantly larger than that required to punch through the stud. A gross adjust mechanism is configured for moving the punch and the die relative to each other over a gross adjust stroke range significantly larger than that required to punch through the stud between an open position and a closed position. The open position allows the positioning of the stud between the punch and the die. The closed position is based on the working stroke range to cause punching of the punch through the stud upon actuation of the driving mechanism.

Further, in a preferred embodiment, the C-shaped frame portion includes first and second halves. Each half includes a respective end of the C-shaped frame portion. The gross adjust stroke range is defined along the working axis. The gross adjust mechanism includes a slide member connecting the first and second halves of the C-shaped frame portion. The slide member allows movement of the die toward and away from the punch along the working axis. The gross adjust mechanism further includes a lock device for unlocking the slide member to allow movement of the slide member, and for locking the slide member to prevent movement of the slide member during actuation of the driving member.

Preferably, both ends of the C-shaped frame portion include undercut jaw portions to allow positioning of differently shaped studs between the punch and the die.

Further, in carrying out the present invention, an apparatus for punching knock-outs out of light gauge steel framing studs used in building construction to form holes of sufficient size to allow building wiring and piping to extend therethrough comprises a compact hand held frame, a punch and die assembly, and a gross adjust mechanism. The gross adjust mechanism includes a shaft oriented along the working axis and having first and second ends. A punch is mounted to the shaft first end, and the shaft slidably cooperates with the frame to move the punch relative to the die over the gross adjust stroke range between the open and closed positions. A driving mechanism comprises a lever pivotally attached to the frame, and having a grip portion proximate the handle enabling the user to squeeze the handle and lever together. An advance sear cooperates with the shaft and the lever to cause the shaft to incrementally advance the punch toward the die each time the lever grip portion is squeezed toward the handle. A retract sear cooperates with the shaft and the frame to enable the shaft to freely advance while preventing the shaft from retracting after each incremental advance.

The advantages accruing to the present invention are numerous. For example, embodiments of the present invention provide a compact hand held tool for punching steel studs to form holes of sufficient size to allow wiring and piping to extend therethrough. Further, the gross adjust mechanism and undercut jaws provide tool versatility, particularly for punching holes in steel studs which are already secured within a partially constructed frame. Preferably, the punch is configured with respect to the die cavity such that punching the hole produces a knock-out. Still further, it is preferred that an annular gap between the punch and the die cavity, when the punch is extended into the die cavity, is sufficiently small such that the punched hole is substantially flangeless. That is, the hole sufficiently lacks sharp tongues or flanges that would damage the wiring or piping.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIGS. 9*a*–9*e* illustrate an alternative embodiment of the present invention in which a pulley arrangement is employed to move the punch and die assembly over the gross adjust stroke range;

BEST MODE FOR CARRYING OUT THE INVENTION

Figure 1:
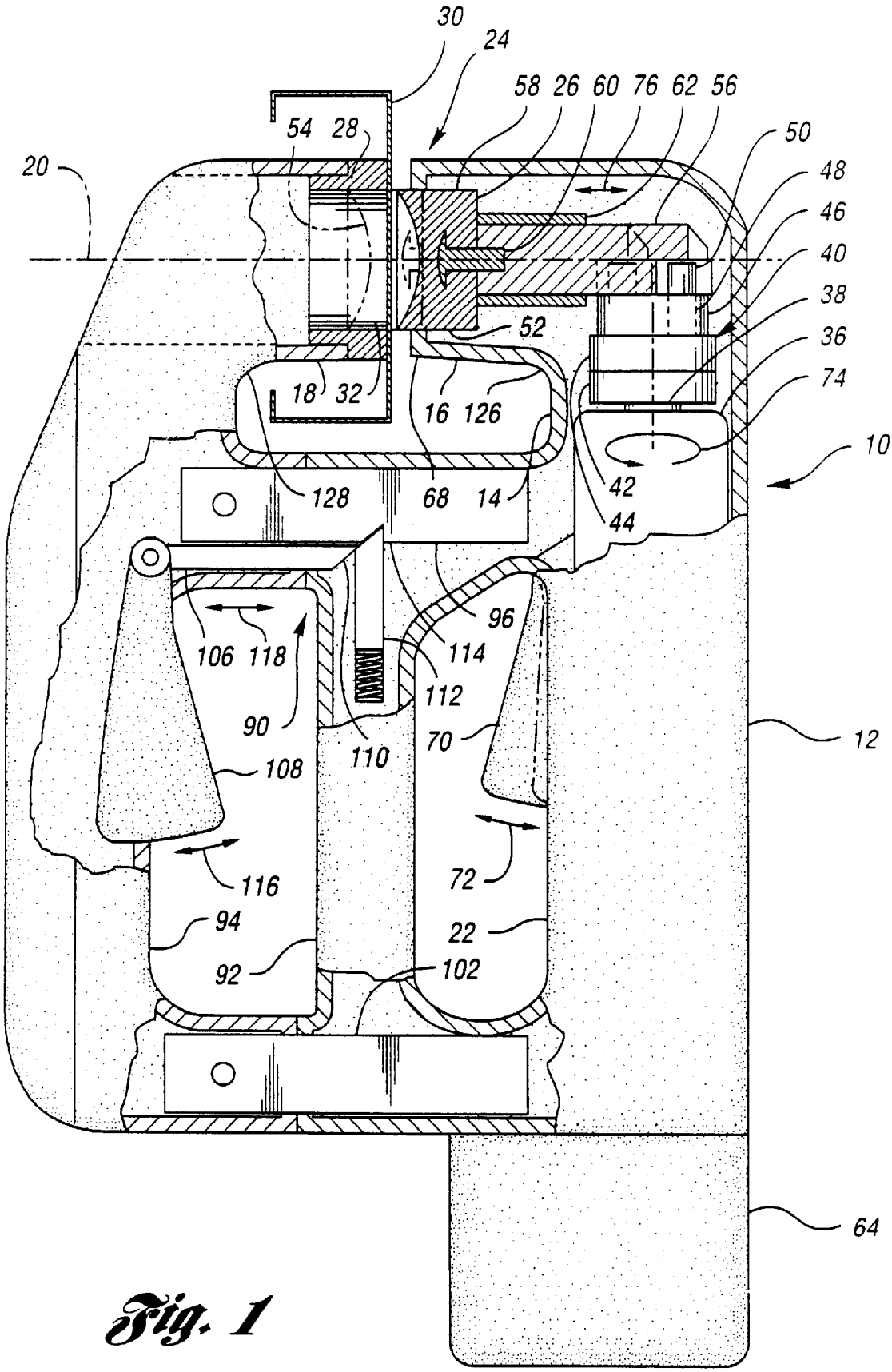
FIG. 1 is a side elevational view in partial broken away section illustrating an apparatus of the present invention for punching steel studs, showing the punch and the die in the closed position with a stud therebetween.
Figure 2:
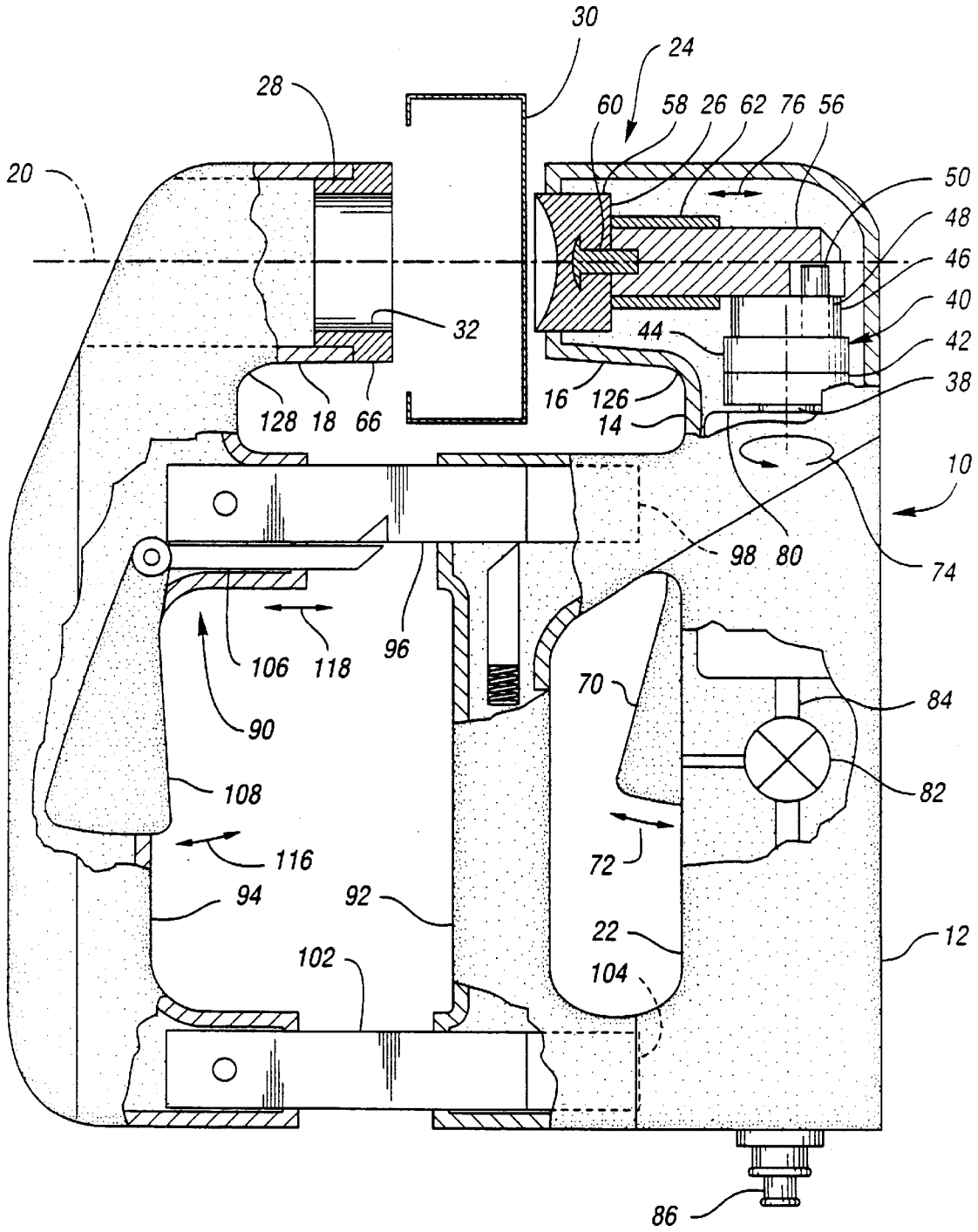
FIG. 2 is a side elevational view similar to FIG. 1, showing the punch and the die in the open position allowing the positioning of the stud therebetween.

With reference to FIGS. 1 and 2, an apparatus for punching steel studs is generally indicated at 10. The apparatus 10 includes a compact hand held frame 12. The frame 12 has a generally C-shaped portion 14 with first and second ends 16 and 18, respectively. The first end 16 and second end 18 are spaced apart and located along a working axis 20 for receiving a stud therebetween. A handle 22 is provided for gripping by a user when operating the apparatus 10.

A punch and die assembly 24 includes a punch 26 and a die 28. Punch 26 is mounted to first end 16 of C-shaped frame portion 14. Die 28 is mounted to second end 18 of C-shaped frame portion 14, opposite punch 26. The stud 30 is shown between punch 26 and die 28. Punch 26 and die 28 are mounted for movement relative to each other along the working axis 20. Die 28 has a cavity 32 so that punch 26 may extend into cavity 32 of die body 28, punching through stud 30 during operation.

An actuatable driving mechanism, such as an electric motor 36 (FIG. 1), is mounted to the frame 12. Electric motor 36 (FIG. 1) has a drive shaft 38. A gear reduction assembly 40, such as a cycloidal gear set, has an input portion 42 and an output portion 44. Input portion 42 of gear reduction assembly 40 is driven by drive shaft 38. Output portion 44 of gear reduction assembly 40 drives punch and die assembly 24 via a suitable cam mechanism, such as cam mechanism 46.

As shown, cam mechanism 46 includes a slot 48 located on output portion 44 of gear reduction assembly 40. Punch 26 includes a punch body 56 secured to a punch head 58 by a fastener 60. The punch body 56 is supported by a bearing 62. Cam mechanism 46 further includes a roller pin 50 which cooperates with slot 48 to impart reciprocal driving motion to punch 26.

Figure 3:
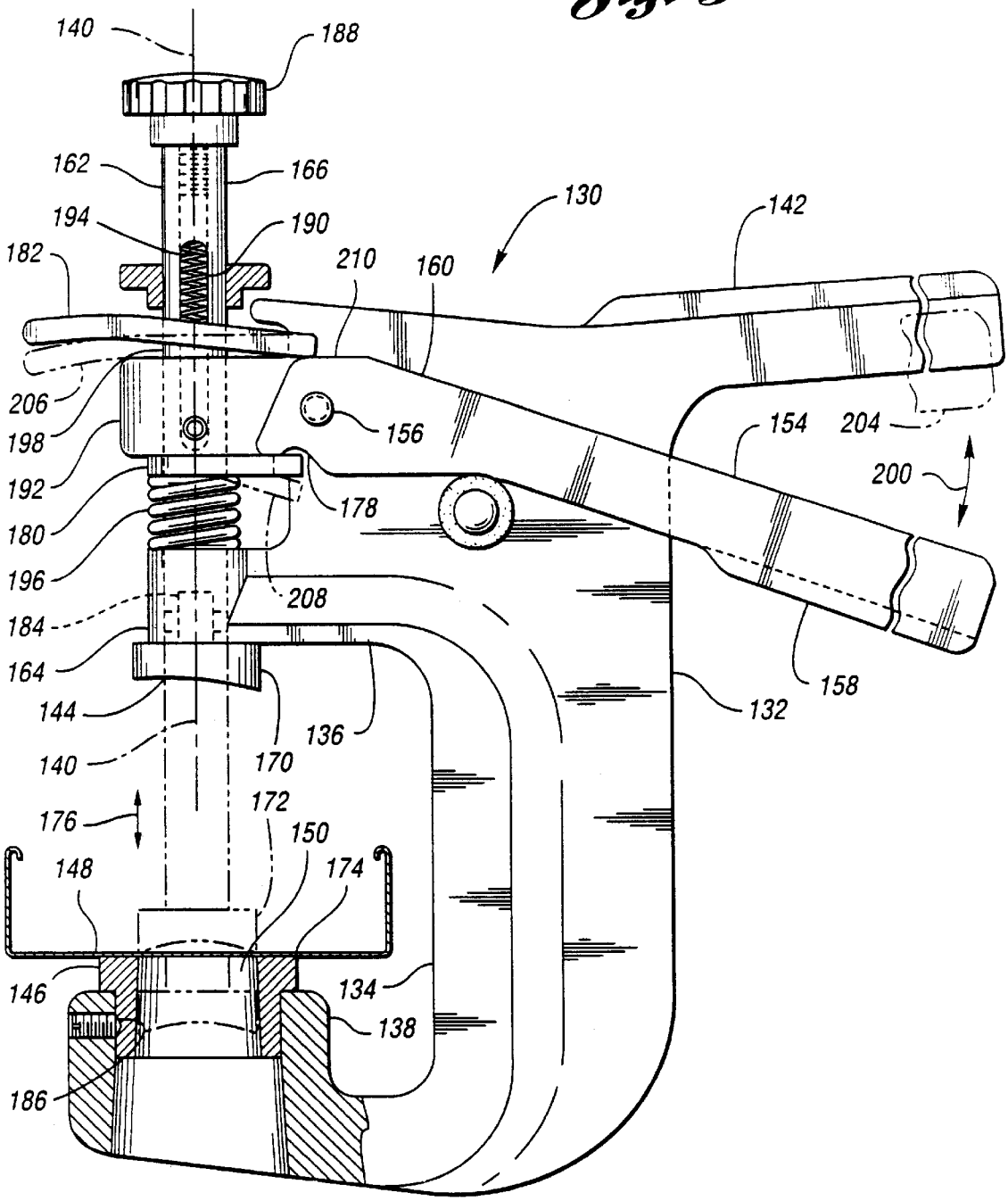
FIG. 3 is a side elevational view of another apparatus of the present invention in which the stud is punched by squeezing the handle and lever to incrementally advance the punch into the die cavity.

As best shown in FIG. 1, electric motor 36 is powered by a suitable power source such as a battery source 64. However, embodiments of the present invention may include a power cord for connection to a conventional power outlet. Alternatively, other types of driving mechanism may be utilized. For example, instead of using an electric motor as best shown in FIG. 1, a turbine may be used as best shown in FIG. 2, or a handle and lever incremental advance mechanism may be used as best shown in FIG. 3, all of which will be described in detail herein. Further, other driving mechanisms may be used as is to be appreciated by one of ordinary skill in the art.

It is to be understood that the electric motor driven embodiment illustrated in FIG. 1 and the turbine driven embodiment illustrated in FIG. 2 operate substantially identically, apart from their respective drive mechanisms. To simplify the description of the invention, like reference numerals are used in FIGS. 1 and 2 to indicate similar elements. Further, in the following description, reference is generally made to both FIGS. 1 and 2. When necessary, specific reference to either FIG. 1 or FIG. 2 is made by a parenthetical reference.

With continuing reference to FIGS. 1 and 2, power is selectively supplied to electric motor 36 (FIG. 1) by pressing trigger 70. Trigger 70 is movable as indicated by arrow 72. Drive shaft rotation is indicated by arrow 74. Drive shaft 38 may be rotated in either direction. The rotation of drive shaft 38 causes reciprocal movement of punch 26 over a working stroke range as indicated by arrow 76. Punch 26 moves between a deactuated position, indicated at 52 (FIG. 1), and an actuated position, indicated at 54 (FIG. 1). In the deactuated position 52 (FIG. 1), punch 26 and die 28 are spaced apart with the stand 30 positioned therebetween. In the actuated position 54 (FIG. 1), punch 26 extends into the die cavity 32 by punching through the stud 30.

Alternatively, as best shown in FIG. 2, the driving mechanism may be a turbine 80. Turbine 80 drives drive shaft 38 and is powered from a compressed fluid source (not specifically illustrated). A valve 82 is actuatable by trigger 70, and actuates turbine 80 by opening turbine input 84, and deactuates turbine 80 by closing turbine input 84. An inlet connector 86 is located on frame 12 for connection to a suitable fluid source such as a compressed air tank. Gear reduction assembly 40 may provide more speed reduction in the turbine driven embodiment than in the electric motor driven embodiment to accommodate for increased drive shaft speed in the turbine.

In embodiments of the present invention, the apparatus is configured such that the punched holes are of sufficient size to allow wiring and piping to extend therethrough. Further, in preferred embodiments, the punch is configured with respect to the die to produce a knock-out when punching the hole. One technique that may be utilized to produce knock-outs is sizing the punch relative to the die cavity such that an annular gap between the punch and the die cavity, when the punch is extended into the die cavity, is sufficiently small such that the punched hole produces a knock-out and is substantially flangeless. That is, a substantially flangeless punched hole is sufficiently lacking sharp tongues or flanges that would damage the wiring or piping intended to pass therethrough.

With reference to FIGS. 1 and 2, a gross adjust mechanism 90 is configured for moving the punch 26 and the die 28 relative to each other over a gross adjust stroke range significantly larger than that required to punch through the stud between an open position indicated at 66 (FIG. 2), and a closed position indicated at 68 (FIG. 1). In a preferred embodiment, C-shaped frame portion 14 includes a first half 92 and a second half 94. Electric motor 36 (FIG. 1) or turbine 80 (FIG. 2) is disposed in first housing half 92. Second housing half 94 is connected to first housing half 92 by a lockable slide member 96 fixed to second housing half 94, and a corresponding guide slot 98 within first housing half 92. Another slide member 102 is fixed to second housing half 94 and cooperates with a corresponding guide slot 104 in first housing half 92. Sliding members 96 and 102 allow sliding movement of the die 28 toward and away from the punch 26 along the working axis 20, over the gross adjust stroke range.

A lock device for gross adjust mechanism 90 is generally indicated at 106. A trigger 108 is operable to unlock the device. Trigger 108 connects to arm 110 which engages lock member 112. When trigger 108 is deactuated, as best shown in FIG. 1, lock member 112 engages a recess 114 in slide member 96 to lock the slide member 96 and prevent movement of the slide members 96 and 102 during actuation of the driving mechanism (electric motor 36, turbine 80, or another suitable driving mechanism). Actuation of trigger 108, which is indicated by arrow 116, causes movement of arm 110 as indicated by arrow 118, causing lock member 112 to disengage from recess 114. Disengagement of lock member 112 from recess 114 unlocks the slide member 96 to allow sliding movement of die 28 toward and away from punch 26.

Further, in a preferred embodiment, both ends 16 and 18 of C-shaped frame portion 14 include undercut jaw portions 126 and 128 to allow positioning of differently shaped studs between punch 26 and die 28. The gross adjust stroke range is significantly larger than that required to punch through the stud to allow positioning of differently shaped studs between punch 26 and die 28. The working stroke range is not significantly larger than that required to punch through the stud to allow a short powerful stroke for the punch and die assembly. Thus, the advantages of undercut jaws on the C-shaped frame ends are immense.

It is to be appreciated that gross adjust mechanism 90 may be constructed in a variety of other ways in addition to that utilizing slide members 96 and 102. For example, the gross adjust stroke range may be defined along a plane substantially perpendicular to the working axis. A lockable hinge member connecting the first and second halves of the C-shaped frame portion allows hinged movement of the die toward and away from the punch along the plane. The lock device allows unlocking of the hinge member to move the hinge member through the plane, and allows locking of the hinge member to prevent movement of the hinge member during operation of the driving mechanism.

Further, for example, the gross adjust mechanism may include a lockable pivot member connecting the first and second halves of the C-shaped frame portion and allowing arcuate pivotal movement of the punch toward and away from the die along a plane parallel to the working axis. A lock device allows unlocking and locking of the pivot member.

It is to be appreciated that the loading experienced by the gross adjust mechanism may be very extreme. There are various alternatives available for the design of the gross adjust mechanism; however, the slide members are a preferred version thereof.

Alternatively, the gross adjust mechanism may be omitted, provided that the working stroke range is sufficiently large so as to allow positioning of a stud between the punch and die. However, the use of a gross adjust mechanism is preferred so that the working stroke range may be shortened, increasing the applied force from punch 26. Further, undercut jaws are preferably employed in conjunction with the gross adjust mechanism to provide increased tool versatility.

Further, it is to be appreciated that there are various alternative embodiments for the cam mechanism, which is illustrated as a slot and pin arrangement. For example, a spring may be disposed within the frame to urge the punch away from the die. A cam lobe mounted to the output portion of the gear reduction assembly may force the punch through the stud against the bias of the spring upon actuation of the driving mechanism.

With reference to FIG. 3, another embodiment of the present invention will now be described. An apparatus for punching steel studs is generally indicated at 130. Apparatus 130 includes compact hand held frame 132 which has a generally C-shaped portion 134. C-shaped portion 134 has first and second ends 136 and 138, respectively. The first and second ends 136 and 138, respectively, are located in a spaced apart relationship along a working axis 140. A handle 142 is sized to be grasped by one hand of the user of the press, and extends generally radially outward from the working axis 140.

A punch and die assembly includes a punch 144 mounted at first end 136 of C-shaped frame portion 134, and a die 146 mounted at second end 138 of C-shaped frame portion 134. A stud 148 is received between punch 144 and die 146. Die 146 has a cavity 150 for receiving punch 144 during the punching operation.

A lever 154 is pivotally attached to frame 132 by pivot pin 156. Lever 154 is provided with a grip portion 158, and a fork portion defined by a pair of generally parallel, spaced apart fork members 160.

The gross adjust mechanism for apparatus 130 includes a shaft 162 oriented along the working axis 140 and having first and second ends 164 and 166, respectively. The gross adjust mechanism is configured for moving the punch 144 and the die 146 relative to each other over a gross adjust stroke range between open and closed positions. The open position allows the positioning of the stud 148 between the punch 144 and the die 146, and is shown at 170. In the closed position shown in phantom at 172, the punch 144 and die 146 are near to or in contact with stud 148 while the punch and die assembly is deactuated. Upon actuation, punch 144 extends into die cavity 150 by punching through stud 148, as shown in phantom at 174. The motion of the punch and die assembly, over both the gross adjust range and the working stroke range, is indicated by arrow 176.

Each fork member 160 of lever 154 is provided with a cam surface 178 for cooperation with an advance sear 180. A retract sear 182 cooperates with shaft 162 and frame 132 to enable the shaft 162 to freely advance while preventing the shaft 162 from retracting after each incremental advance. The advance sear 180 cooperates with the shaft 162 and the lever 154 to incrementally advance shaft 162 upon pulling lever 154 toward handle 142.

First end 136 of shaft 162 has a bore 184 which provides means for attachment of punch 144. Second end 138 of C-shaped frame portion 134 has a bore 186 which provides means for attachment of die 146. Of course, other suitable attachment means such as a threaded connection or conventional fastener could be used to facilitate the attachment of punch 144 and die 146.

In order to facilitate the quick advance of the shaft 162, a palm button 188 is provided on the shaft second end 138. This enables a user to manually advance the shaft over the gross adjust stroke range. Shaft 162 has a tubular region in which a retract spring 190 is oriented. Pin 192 is attached to frame 132 and extends radially inwardly through a slot 194 formed in shaft 162 to engage retract spring 190. As the shaft 162 is advanced, spring 190 abuts pin 192 causing the spring to compress.

Advance sear 180 is biased in a direction opposite the direction of shaft advance by advance sear spring 196. After each incremental advance of the shaft 162 and advance sear 180, the advance sear spring 196 returns the advance sear to the position shown at 180.

Retract sear 182 is biased toward a normally locked orientation by retract sear spring 198. As the shaft advance is steered by the user pushing directly upon palm button 188 or by squeezing lever 154, retract sear 182 initially moves slightly with the shaft or a sufficient distance to cause the retract sear to rotate relative to the shaft pivoting about the engagement with the frame so that the shaft and the retract sear become unlocked. It is during the relative movement of the retract sear and the frame that the retract sear spring 198 is compressed. The unlocked orientation of the retract sear is shown in phantom at 206.

The operation of apparatus 130 will now be described. Stud 148 is positioned between punch 144 and die 146. The user presses down on palm button 188 causing retract sear spring 198 to compress sufficiently such that retract sear 182 releases the shaft 162. The user presses down on palm button 188 to move punch 144 and die 146 over the gross adjust range, until punch 144 and die 146 are near to and preferably in contact with stud 148. Upon release of palm button 188 by the user, retract sear spring 198 urges retract sear 182 such that the retract sear 182 bites into the shaft 162, preventing the moving apart of the punch 144 and die 146.

Squeezing the lever from its at rest position indicated at 154 to its operated position indicated at 204 causes cam surface 178 to press on advance sear 180. Cam surface 178 presses on advance sear 180 such that advance sear 180 takes on a slightly angled orientation relative to its at rest position, compressing spring 196 to bite into the shaft 162. Advance sear 180 bites into shaft 162 as the lever is moved between at rest position 202 and operating position 204 in the direction of arrow 200. Prior to the lever reaching the operated position 204, advance sear 180 bites shaft 162 to cause shaft 162 and punch 144 to incrementally advance toward die 146. The biting advance sear is shown in phantom at 208.

Upon release of the lever, advance sear 180 returns to its at rest position, and shaft 162 is maintained in its incrementally advanced position by retract sear 182 maintaining its bite into shaft 162. Each time the lever grip portion is squeezed toward the handle, as described above, the advance sear cooperates with the shaft and the lever to cause the shaft to incrementally advance. After initial positioning of punch 144, punch 144 is incrementally advanced into die cavity 150 over the working stroke range, until stud 148 is punched. Once stud 148 is properly punched, it is necessary to open the punch die assembly to facilitate removal of the stud.

In order to open the punch and die assembly, the user can either directly release the retract sear 182 by pressing down against spring 198, or the user can push lever 154 away from handle 142 to cause a second cam surface 210 of lever 154 to engage retract sear 182. As previously described, retract spring 190 axially biases shaft 162 to the retract position. Therefore, once retract sear 182 is released, the shaft 162 will naturally return to the withdrawn position.

Advance sear 180 and retract sear 182 are preferably formed of a hard steel sheet material having a hardness greater than that of shaft 162 to facilitate the biting of the shaft by the sears.

Figure 4:
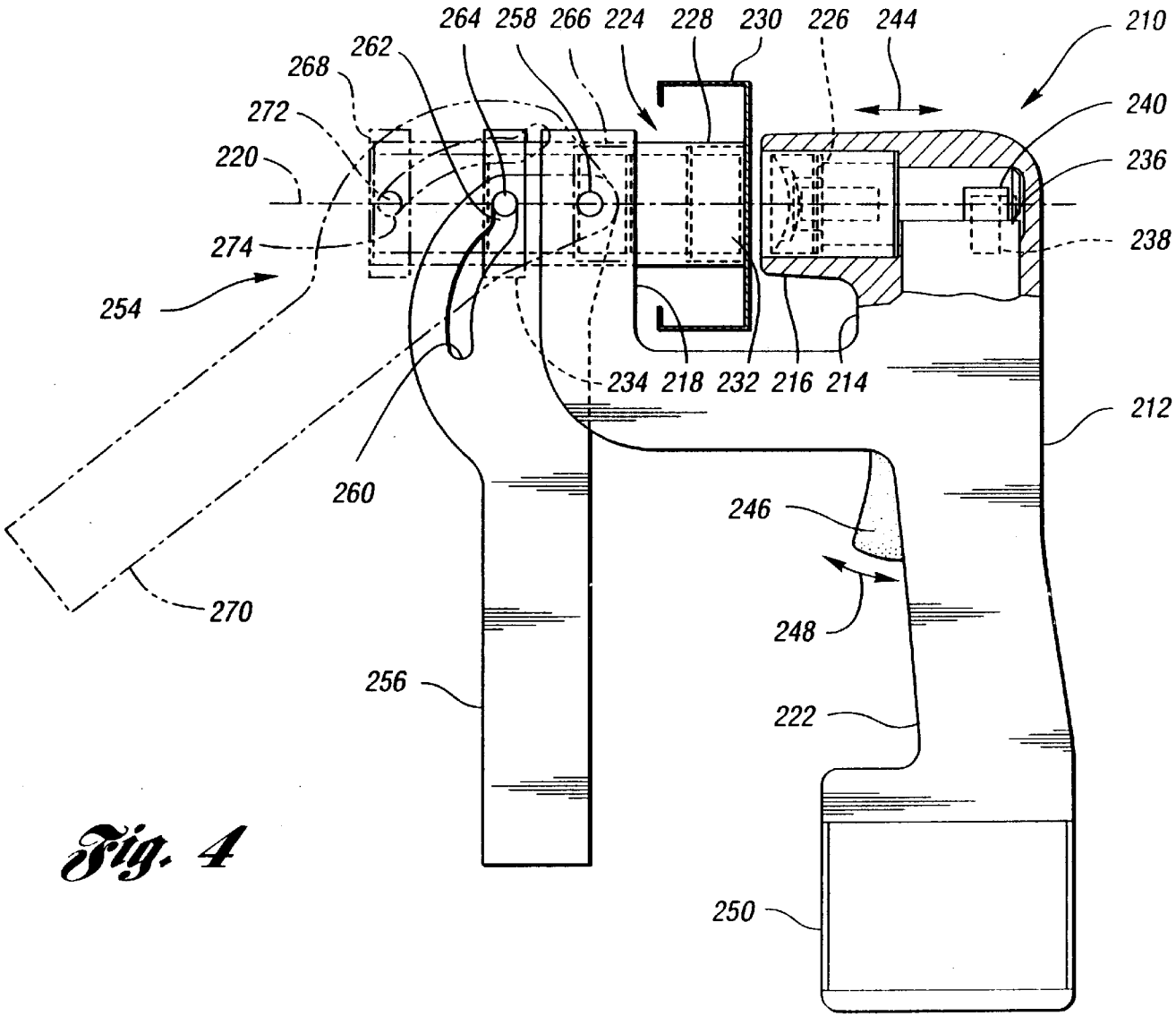
FIG. 4 is a side elevational view of still another apparatus of the present invention in which the gross adjust mechanism includes a slotted lever and pin arrangement.

With reference to FIG. 4, another apparatus of the present invention is generally indicated at 210. A compact hand held frame 212 has a generally C-shaped portion 214 with a punch end 216 and a die end 218, spaced apart along a working axis 220. A handle 222 is provided for gripping by a user. A punch and die assembly 224 includes a punch 226 and a die 228. A stud 230 is punched by extending the punch 226 into the die cavity 232. A die support member 234 is slidably received in the die end 218 of the C-shaped frame portion 214. Die 228 is received in die support member 234.

Similar to FIGS. 2 and 3, apparatus 210 includes a cam mechanism 236 having a slot 238 and roller pin 240 operable to drive punch 226 as indicated by arrow 244 upon actuation of trigger 246, as shown by arrow 248. Trigger 246 actuates a suitable driving mechanism, such as, for example, an electric motor powered by a batter 250. Other driving mechanisms may be used, as previously described.

Figure 16:
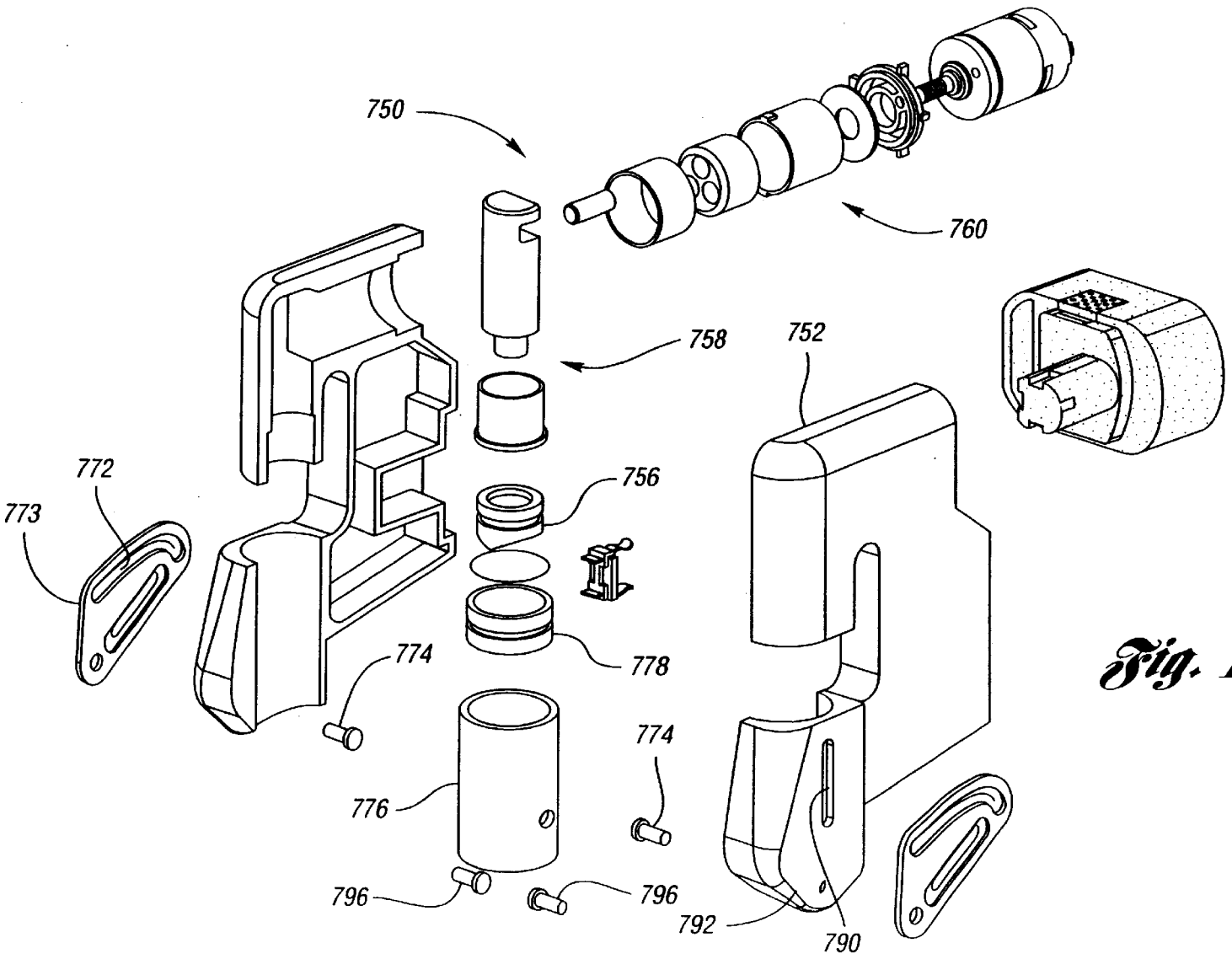
FIG. 16 is an exploded view of the apparatus shown in FIG. 15.

Gross adjust mechanism 254 includes the die support member 234 and a cooperating lever 256. Lever 256 is pivotally attached to the die end 218 of the C-shaped frame portion 214. An arcuate slot 260 is formed on each side of the lever 256. Each slot 260 is configured with an inflection at one end 262. A follower pin 264 is located on each side of die support member 234 and extends outwardly from the die support member periphery. Each slot 260 receives a respective follower pin 264 to guide the die support member 234 and die 238 relative to the punch 226 over the gross adjust stroke range, as the lever 256 is pivoted. Of course, multiple pins and slots may alternatively be provided, or other arrangements may be provided for connecting lever 256 to die support member 234. Further, the slot may have other shapes capable of providing a locked position, for example, as shown in FIG. 16.

In the closed position, the die, die support member, and lever are indicated at 228, 234, and 256, respectively. The lever 256 is pivoted such that the pin 264 is positioned in the inflected end 262 of slot 260 to secure the punch 226 and die 228 in the closed position during actuation of the driving member to punch the stud.

In the open position, which is shown in phantom, the die, die support member, and lever are indicated at 266, 268, and 270, respectively. As shown in phantom, the lever 270 is pivoted such that the pin 272 is positioned in the non-inflected end 274 of slot 260 to place the punch 226 and die 228 into the opened position to allow insertion of a stud.

It is to be appreciated that embodiments of the present invention provide a compact, hand held apparatus for punching steel studs to form holes of sufficient size to allow wiring and piping to extend therethrough. The compactness of the apparatus provides great versatility during use thereof. For example, many times during construction of steel frame homes and structures, there is a need to punch holes in steel studs or other steel components after partial assembly of the frame or structure. In these situations, space constraints may be very severe, so severe that a conventional large lever type punch is inadequate in those space constraints. The compact, hand held punch of the present invention facilitates punching holes in areas having severe space constraints. Further, it is to be appreciated that many designs in addition to those illustrated will be apparent to one of ordinary skill in the art, for example, the gross adjust slide mechanism formed by slide members 96 and 102 (FIGS. 1 and 2), that formed by shaft 162 and related components (FIG. 3), or that formed by lever 256 and die support member 234 (FIG. 4), may be replaced by or supplemented with other gross adjust mechanisms.

Further, it is to be appreciated that the compactness of embodiments of the present invention is advantageous in that the punch is sized to form large holes for wiring and piping. Further, the preferred punch is not of the convex piercer type which generally has a pointed shape and leaves sharp flanges or tongues but is instead generally concave so as to eliminate the undesired tongues and flanges by producing a knock-out.

Figure 5A:
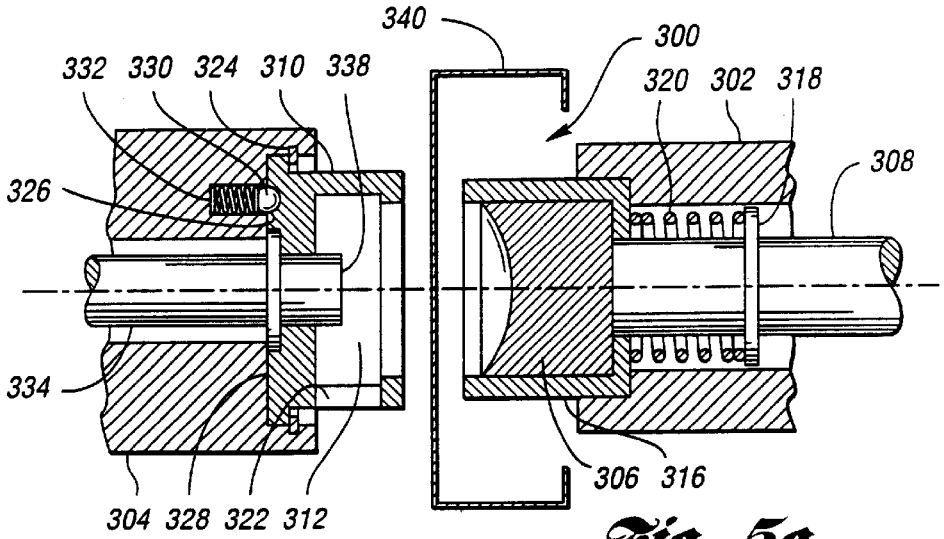
FIGS. 5*a*–5*c* illustrate an alternative embodiment of an apparatus of the present invention for punching steel studs, showing an opening in the die body for allowing the stamped out metal to exit the die cavity.
Figure 5B:
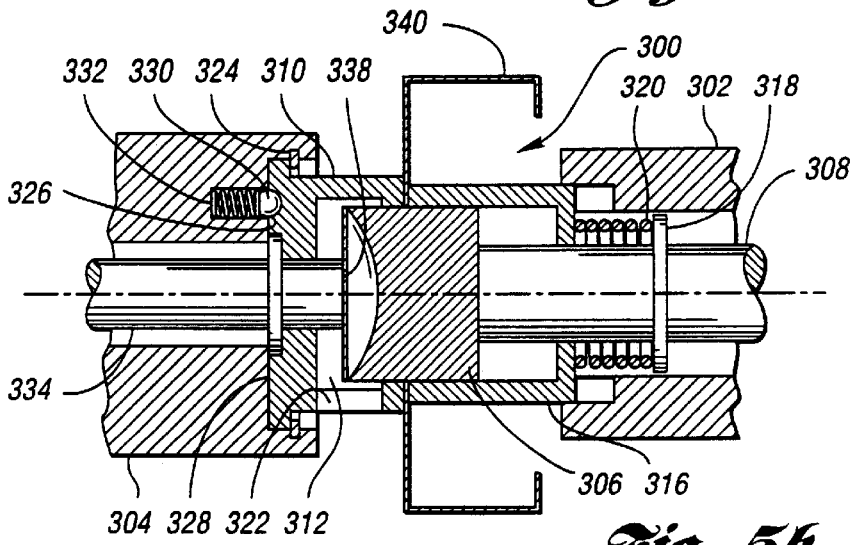
Figure 5C:
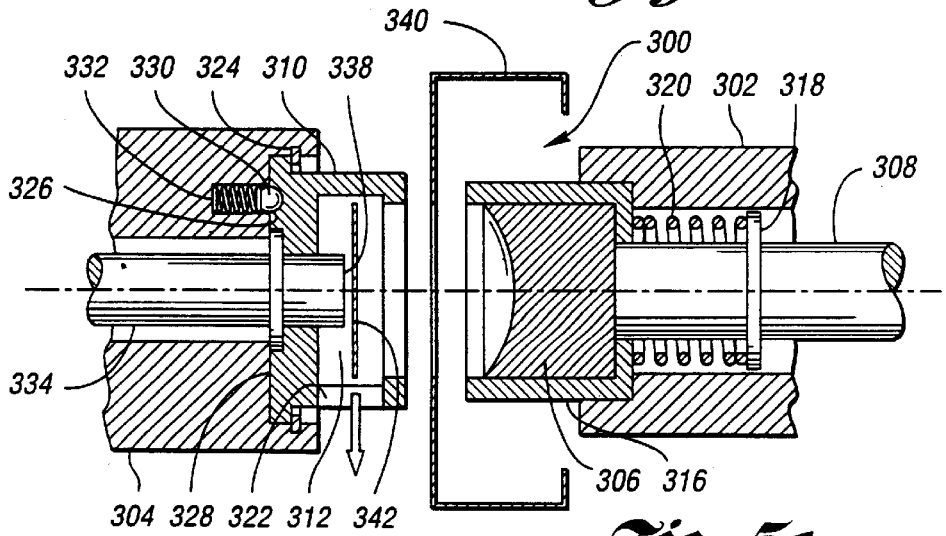

With references to FIGS. 5*a*–5*c*, an alternative punch and die assembly for use in embodiments of the present invention is generally indicated at 300. Assembly 300 includes a punch holder 302 defined at the punch end of the C-shaped frame, and a die holder 304 defined at the die end of the C-shaped frame. A punch 306 is connected to a reciprocating member 308. Reciprocating member 308 is driven by a driving mechanism that may take any number of forms, and is not specifically shown. A die 310 is mounted opposite punch 306. Die 310 has a body defining a die cavity 312 into which punch 306 is extended to punch through the stud 340 to form the punched hole by producing a knock-out. Preferably, although not required, punch 306 is encircled by a sleeve 316 that slidingly engages punch 306. In such an embodiment, a spring seat 318 is fixed with reciprocatable member 308, and a spring 320 biases sleeve 316 toward die 310 such that upon actuation of the driving mechanism (not specifically shown), sleeve 316 engages die body 310 prior to the extension of punch 306 into die cavity 312 to punch out the stamped piece or knock-out.

Die body 310 defines an opening 322 in communication with die cavity 312. Opening 322 is sized such that the knock-out 342 exists die cavity 312 by passing through opening 322, as best shown in FIG. 5*c*. It is to be appreciated that opening 322 may be a very convenient feature during use of a stud punching apparatus of the present invention.

Preferably, die body 310 is rotatably mounted to the C-shaped frame portion such that rotation of die body 310 allows a user to selectively position opening 322 with respect to die holder 304. Die body 310 is retained to die holder 304 by retention clip 324.

Preferably, a lock mechanism is configured with respect to die body 310 and die holder 304 such that die body 310 may be selectively rotated to a desired position with respect to die holder 304, and locked in the desired position by the lock mechanism. For example, the lock mechanism may be a ball and detent arrangement including a plurality of detents 326 circumferentially spaced around die body bottom surface 328 and a ball 330 biased by a spring 332. That is, ball 330 is biased by spring 332 into any one of detents 326, depending on the position of die body 310. If desired, when a gross adjust mechanism is employed, a rod number 334 may extend into die cavity 312 such that punch 306 may press member end 338 to disengage a lock mechanism of the gross adjust mechanism. For example, the lock mechanism may be the slide lock mechanism illustrated in FIGS. 1 and 2, or any other locking mechanism as is appreciated by one of ordinary skill in the art.

As best shown in FIG. 5*a*, punch 306 and die 310 are in the closed position, with punch 306 in the deactuated position. As best shown in FIG. 5*b*, the punch is in the actuated position extending into die 310. Further, as best shown in FIG. 5*c*, after the metal is punched out, knock-out 342 exists die cavity 312 through opening 322.

Figure 6A:
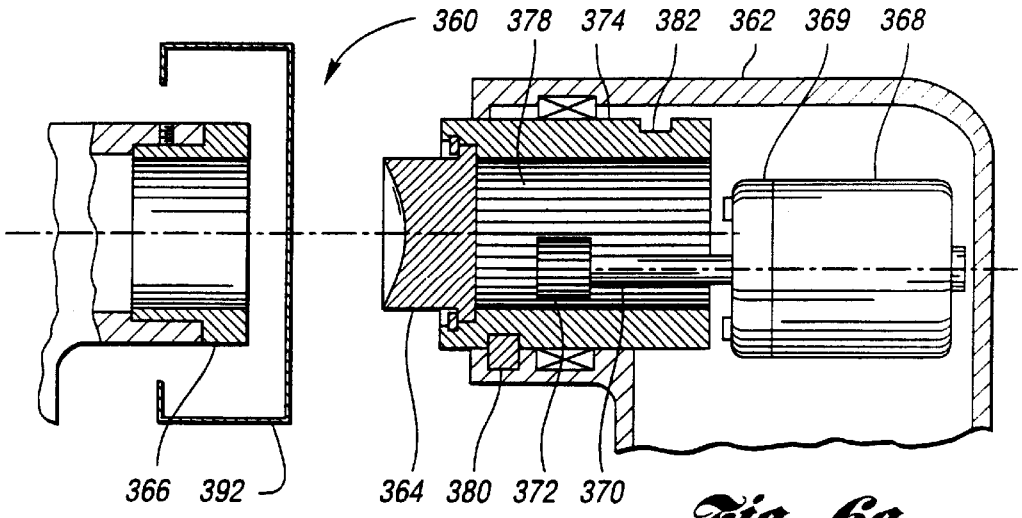
FIGS. 6*a*–6*c* show yet another alternative embodiment of an apparatus of the present invention for punching steel studs, in which rotary motion of the driving mechanism is converted into linear motion of the punch with a cylinder cam having a slot.
Figure 6B:
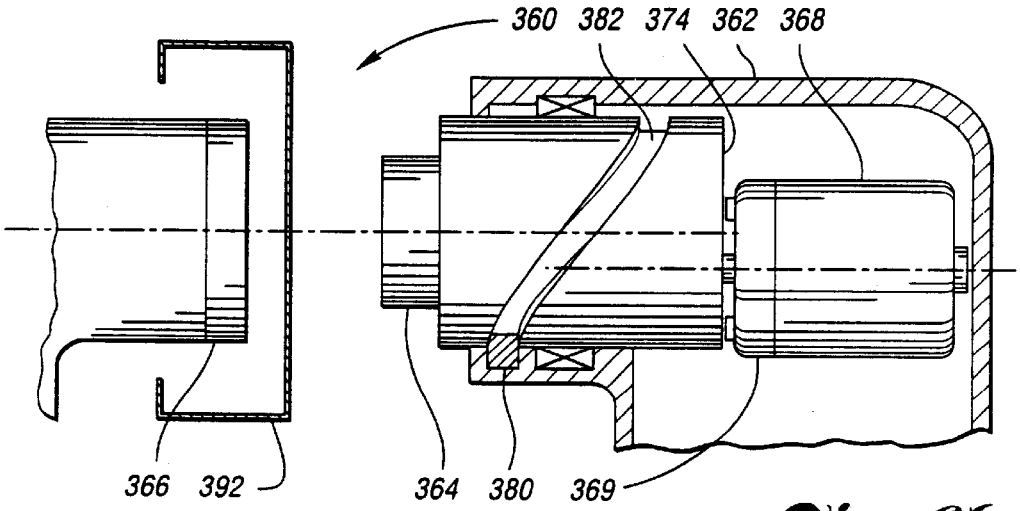
Figure 6C:
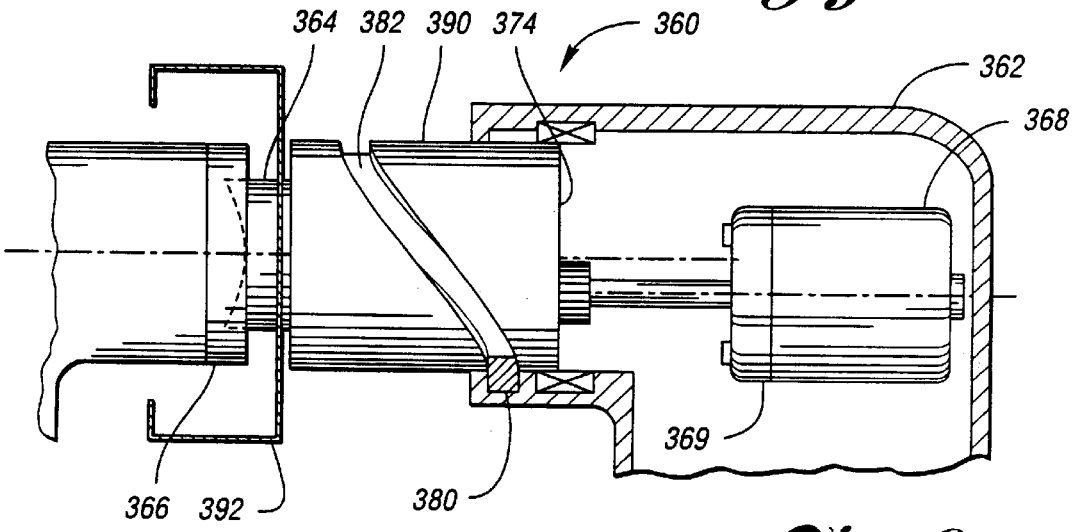

With reference now to FIGS. 6*a*–6*c*, yet another alternative embodiment of the present invention is illustrated. A partial view of an apparatus is generally indicated at 360. Apparatus 360 includes a C-shaped frame portion 362, a punch 364, and a die 366. A driving mechanism 368, which may be a motor or air turbine or other device as described previously, is connected through a gear reduction mechanism 369 to a drive shaft 370. Drive shaft 370 has a pinion 372 at its end. A cylinder cam 374 is fixed to punch 364, and engages a bearing 376. Cylinder cam 374 has an inside gear 378 engaging drive shaft pinion 372. As shown, a pin 380 is affixed to C-shaped frame portion 362, and a slot 382 is defined by the outer surface of cylinder cam 374.

Pin 380 engages slot 382, and slot 382 is shaped such that actuating the driving mechanism causes pinion 372 to rotate cylinder cam 374 such that pin 380 follows slot 382, driving punch 364 over the working stroke range and preferably (as shown) over the gross adjust stroke range, as well. Preferably, slot 382 has a curved path, such as a generally sinusoidal path, such that when punch 364 is approaching die 366, movement of punch 364 is relatively fast compared to movement of punch 364 when stud 384 is engaged.

Preferably, slot 382 is defined by cylinder cam 374; however, it is to be appreciated that a slot may be defined by the C-shaped frame portion, with the pin protruding from cylinder cam 374. Preferably, pin 380 is a roller pin. As best shown in FIG. 6*c,* pin 380 travels along slot 382 to drive punch 364 into die 366, putting the cylinder cam in position 390, through stud 392.

Figure 7A:
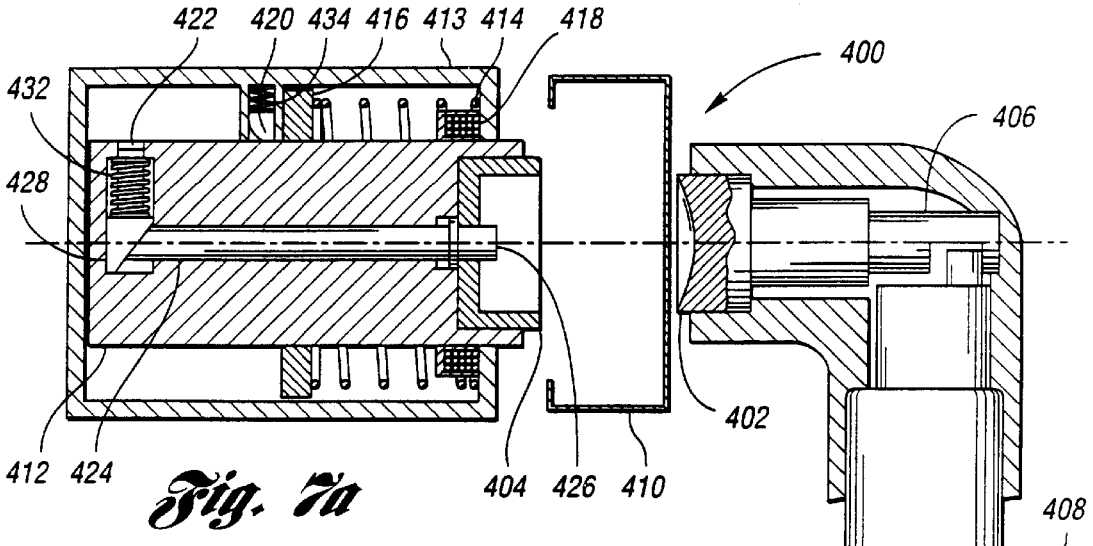
FIGS. 7*a*–7*c* show a further alternative embodiment of the present invention in which an electromagnet is employed to move the punch and die assembly over the gross adjust stroke range.
Figure 7B:
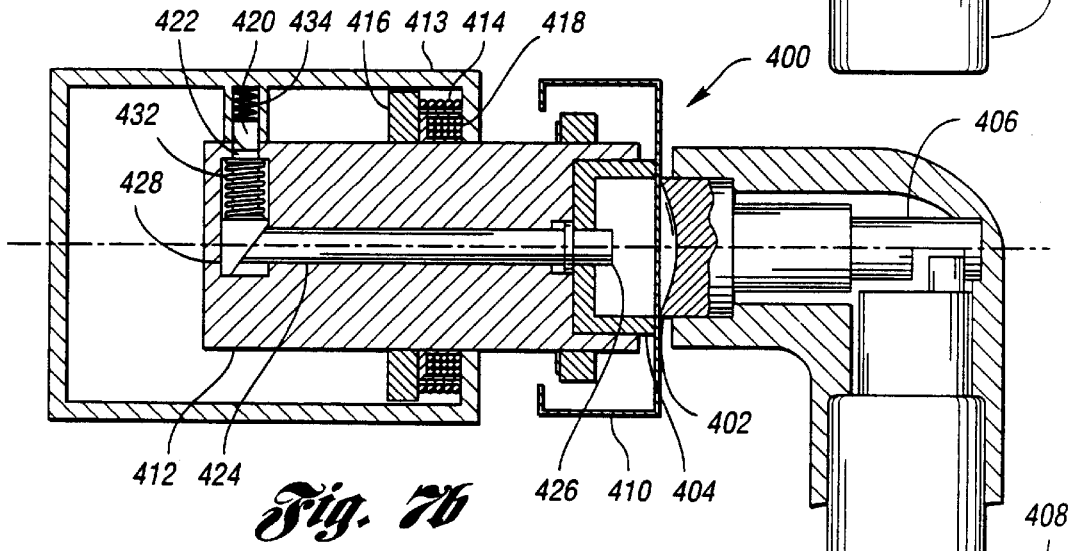
Figure 7C:
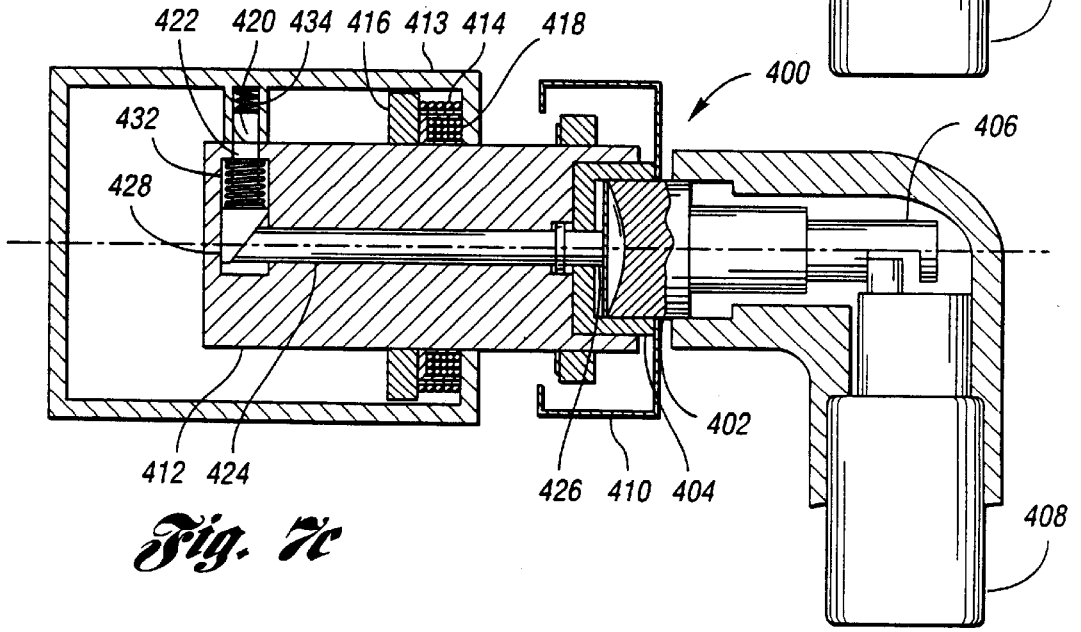

With reference to FIGS. 7*a*–7*c,* an additional embodiment of the present invention is shown, partially illustrating the apparatus at 400. Apparatus 400 includes a punch 402 and die 404. Punch 402 is connected to a reciprocating member 406, driven by a driving mechanism 408. Stud 410 is positioned between punch 402 and die 404. In this embodiment, a die support member 412 is slidably received in the die end 413 of the frame. A spring 414 biases die support member 412 at a spring seat 416 to the open position, as best shown in FIG. 7*a.* An electromagnetic 418 is operative to urge die support member 412 against the bias of spring 414 to the closed position, upon actuation of the electromagnetic 418, as best shown in FIG. 7*b.* After electromagnetic 418 is actuated, driving mechanism 408 is used to drive the punch 402 into die 404.

Preferably, apparatus 400 employs a lock mechanism so that the punch and die assembly remains in the closed position and continued actuation of electromagnetic 418 is not required. In a preferred construction, a lock 420 is biased into opening 422 when die support 412 is in the closed position. A release shaft 424 is pushed at its end 426 by punch 402 after stud 410 has been punched, as best shown in FIG. 7*c.* Release member 424 engages member 428 at an interface with cam angled surfaces on both member 424 and 428 abutting each other. Abutment of the cam angled surfaces pushes member 428 against the bias of spring 432 to resultantly push lock member 420 against the bias of spring 434 and unlock die support member 412, as best shown in FIG. 7*c.*

Figure 8A:
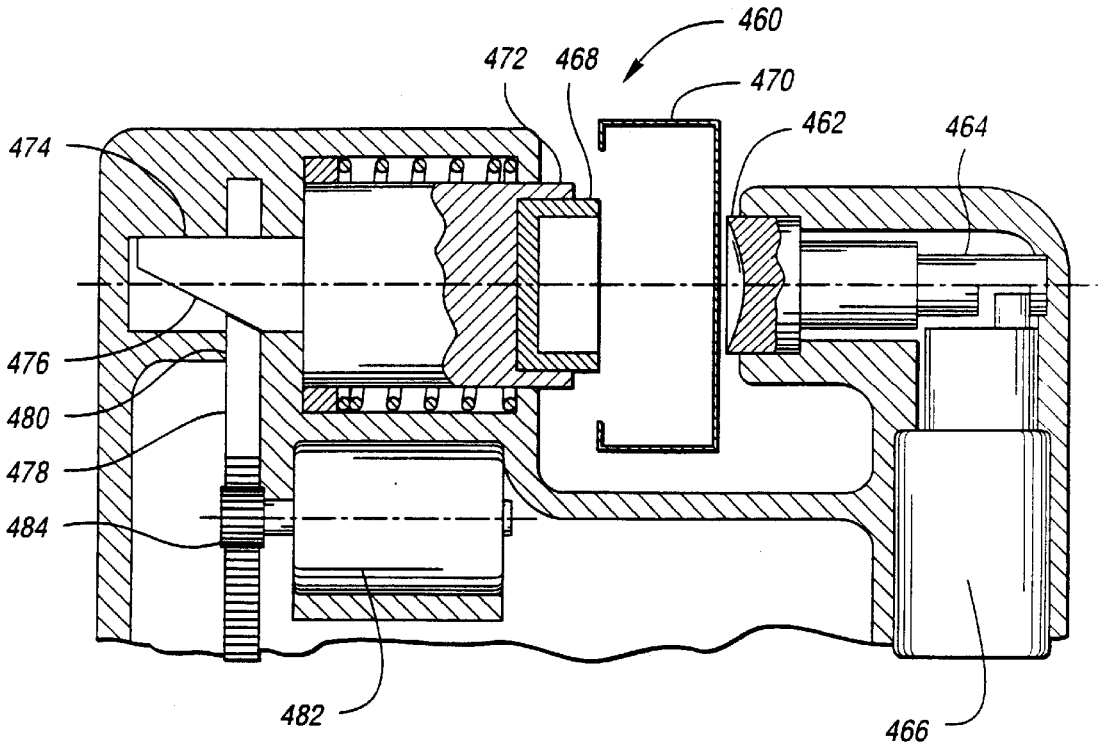
FIGS. 8*a*–8*b* show yet another alternative embodiment of an apparatus of the present invention, in which a rack and pinion arrangement is configured to move the punch and die assembly over the gross adjust stroke range.
Figure 8B:
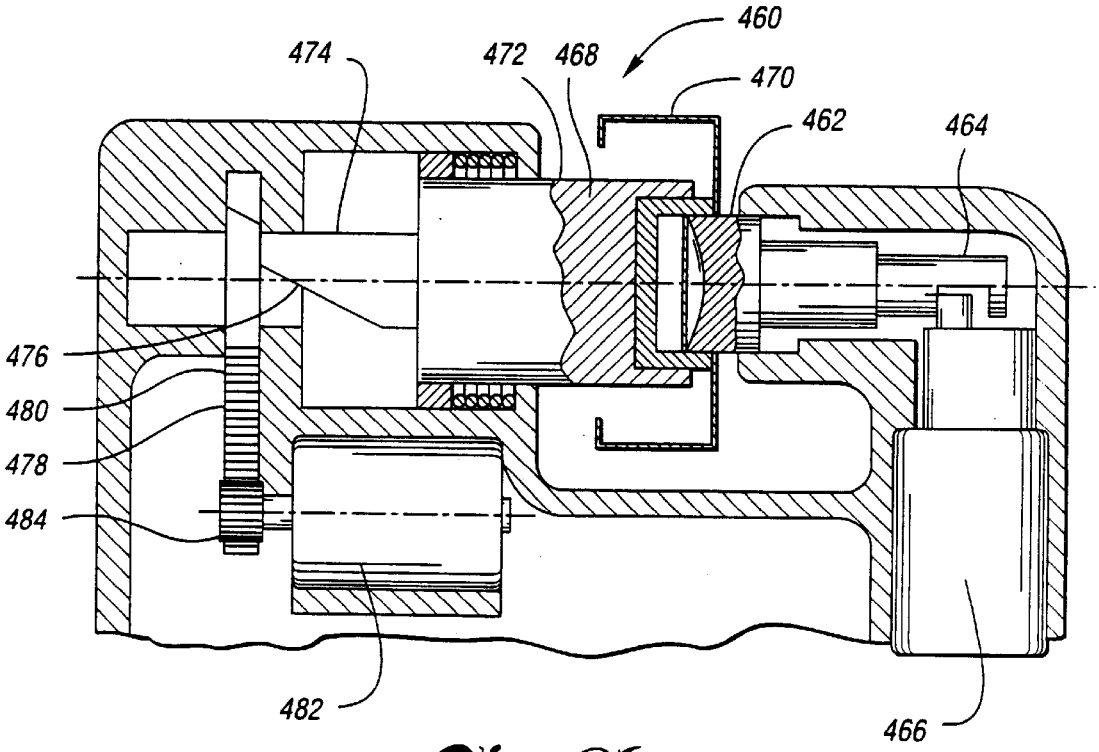

With reference to FIGS. 8*a*–8*b,* yet another alternative apparatus is generally indicated at 460. Apparatus 460 includes a punch 462, reciprocating member 464, a driving mechanism 466, and a die 468. A stud 470 is positioned between punch 462 and die 468. A die support member 474 is slidably received in the die end of the frame. Die support member 472 includes portion 474 having a cam angled surface 476. A rack member 478 has a cam angled surface 480 abutting angled surface 476 of die support portion 474. Rack 478 is driven by a driving mechanism 482 having a drive shaft with a pinion 484 engaging rack 478. Of course, it is preferred that driving mechanism 482 employs a gear reduction mechanism, as is preferred in other embodiments of the present invention. Rack number 478 and pinion 484 are ranged such that rotation of the drive shaft in a first direction causes the rack member cam service 480 to slide against the die support member complimentary cam service 476, moving die 468 to the closed position, as best shown in FIG. 8*b.* Further, rotation of the drive shaft in a second direction allows the die to retreat to the open position, shown in FIG. 8*a.*

With reference to FIGS. 9*a*–9*e,* yet another embodiment of the present invention is generally indicated at 500. Apparatus 500 include punch 502, die 504, driving member 506 engaging punch 502, and driving mechanism 508, which preferably includes a gear reduction mechanism. A stud 510 is positioned between punch 502 and die 504. Apparatus 500 includes a die support member 512, with a lock member 514 and locking arrangement 516 similar to that shown in FIGS. 8*a* and 8*b* in some aspects.

Figure 9A:
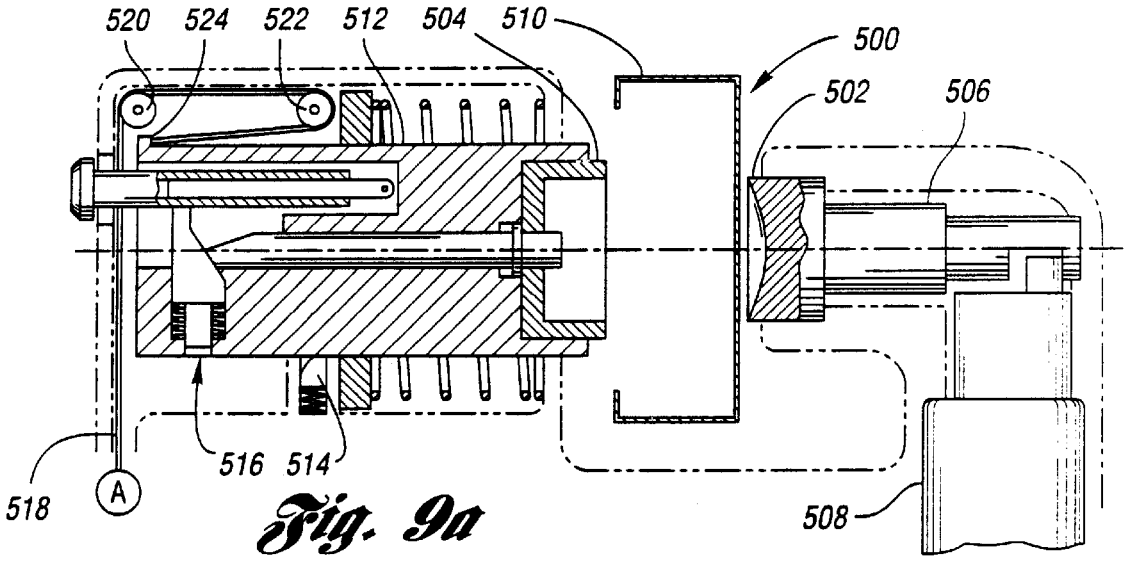
Figure 9B:
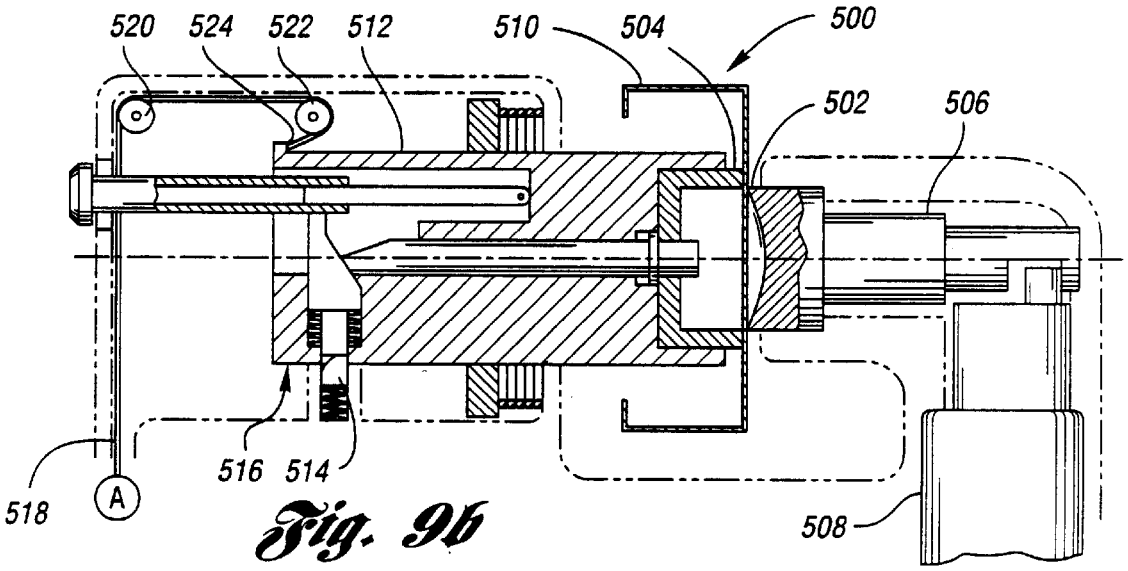
Figure 9C:
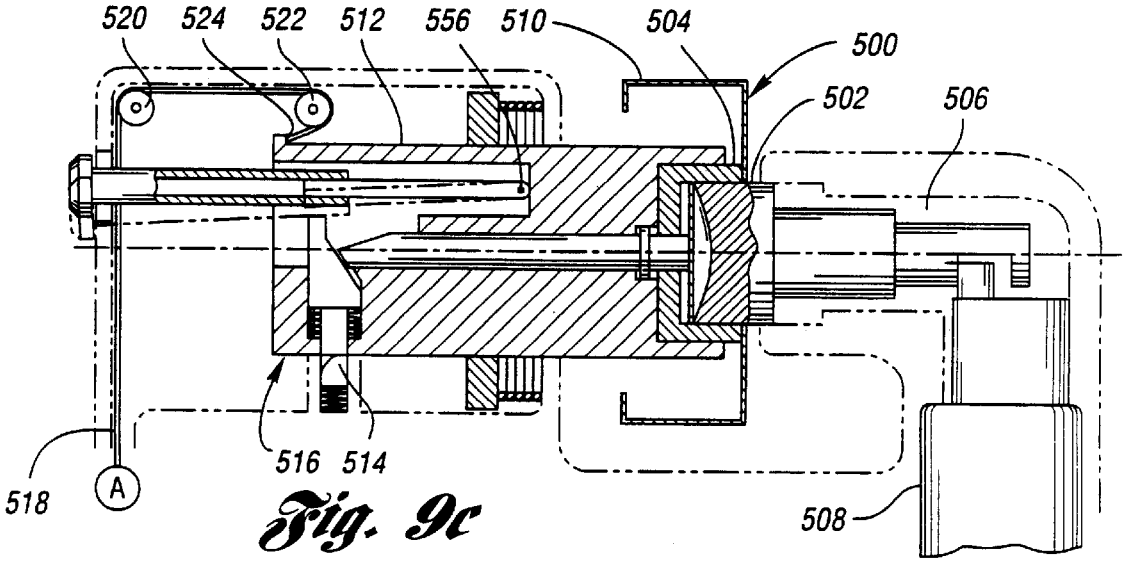
Figure 9B:
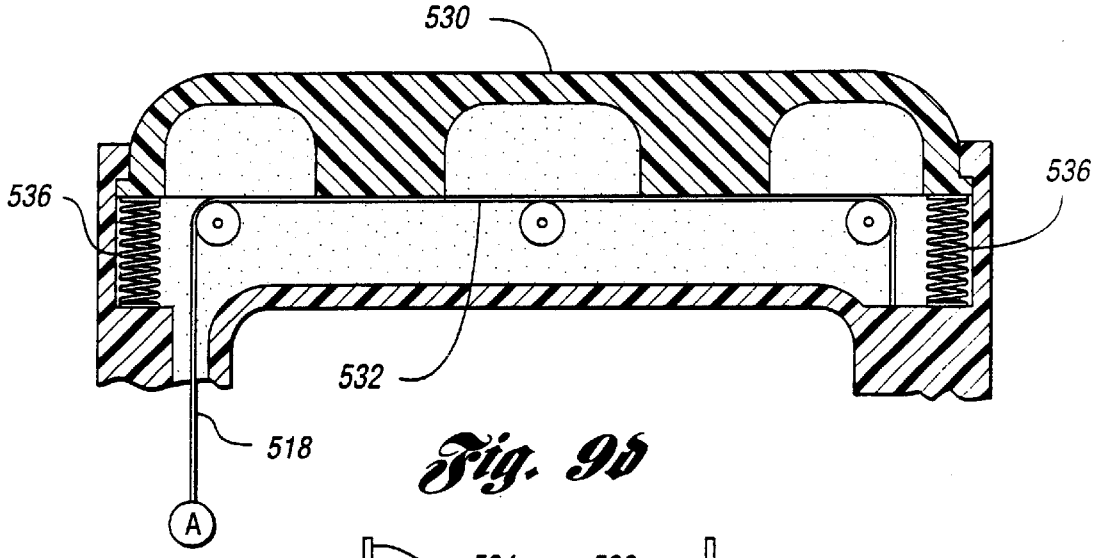
Figure 9E:
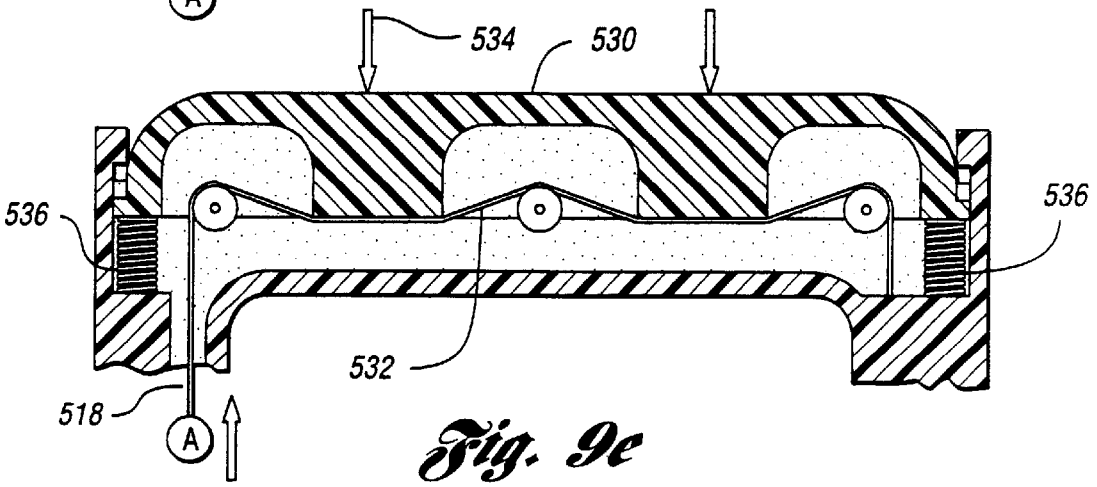

With the continuing reference to FIGS. 9*a*–9*e,* a pulley arrangement includes wire 518 extending about rollers 520 and 522 and connecting to die support member 512 at attachment point 524. As best shown in FIGS. 9*d*–9*e,* a trigger arrangement 530 at the apparatus handle is used to pull a portion 532 of wire 518. As best shown in FIG. 9*d,* the trigger 530 is not squeezed. As best shown in FIG. 9*e,* the trigger 530 is squeezed in a direction indicated by arrow 534, against the bias of spring 536, pushing wire portion 532 and resultantly pulling wire portion 518 (see FIGS. 9*a*–9*c*).

By squeezing the trigger arrangement and pulling the wire, the pulley arrangement configuration urges die support member 512 to cause die 504 to move to the closed position, as best shown in FIG. 9*b.* Of course, it is to be appreciated, that the pulley arrangement may be confirmed in a variety of ways, and it is not required that squeezing trigger 530 closes the punch and die assembly. That is, squeezing the trigger may be employed to open the punch and die assembly by changing the location of the attachment point 524 to die support 512.

As best shown in FIG. 9*c,* in a preferred embodiment, an emergency release button 552 is provided such that elongated member 554 pivots about connection 556 to disengage locking mechanism 516.

Figure 10A:
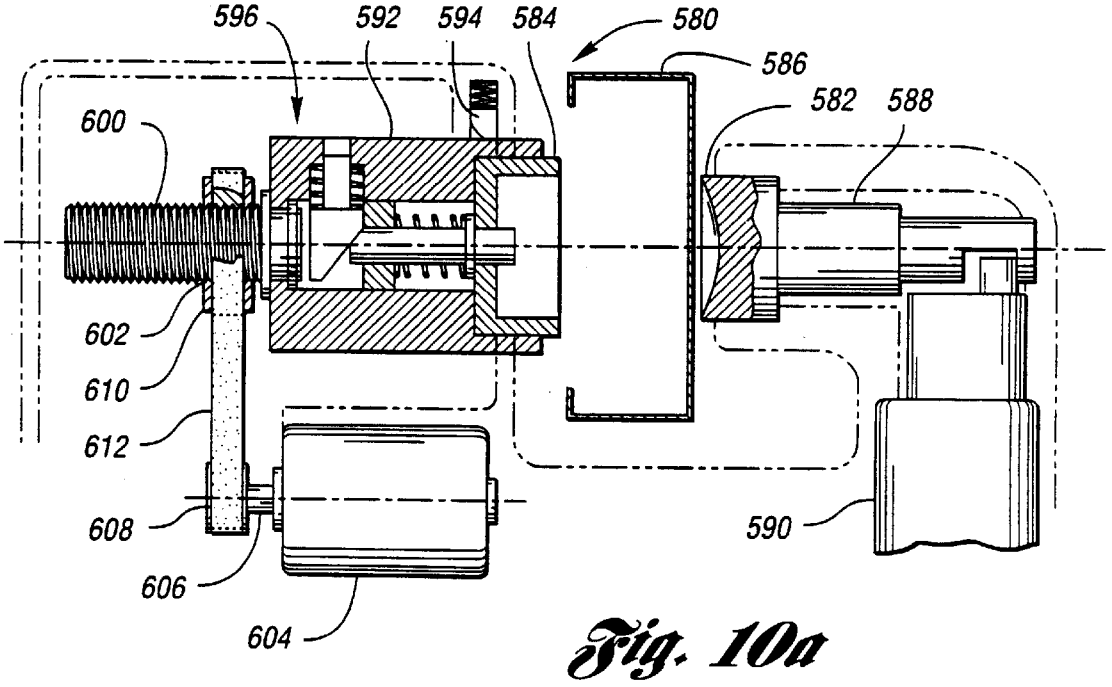
FIGS. 10*a*–10*c* illustrate an embodiment of the present invention in which a threaded member and a nut are used to move the punch and die assembly over the gross adjust stroke range.
Figure 10B:
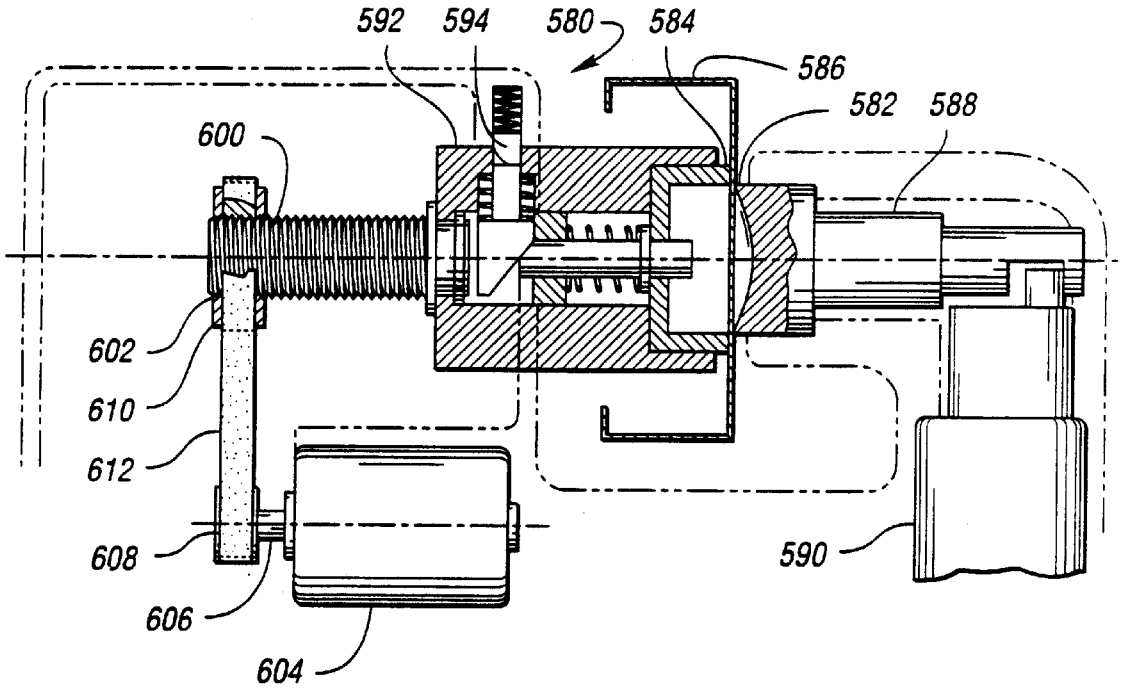
Figure 10C:
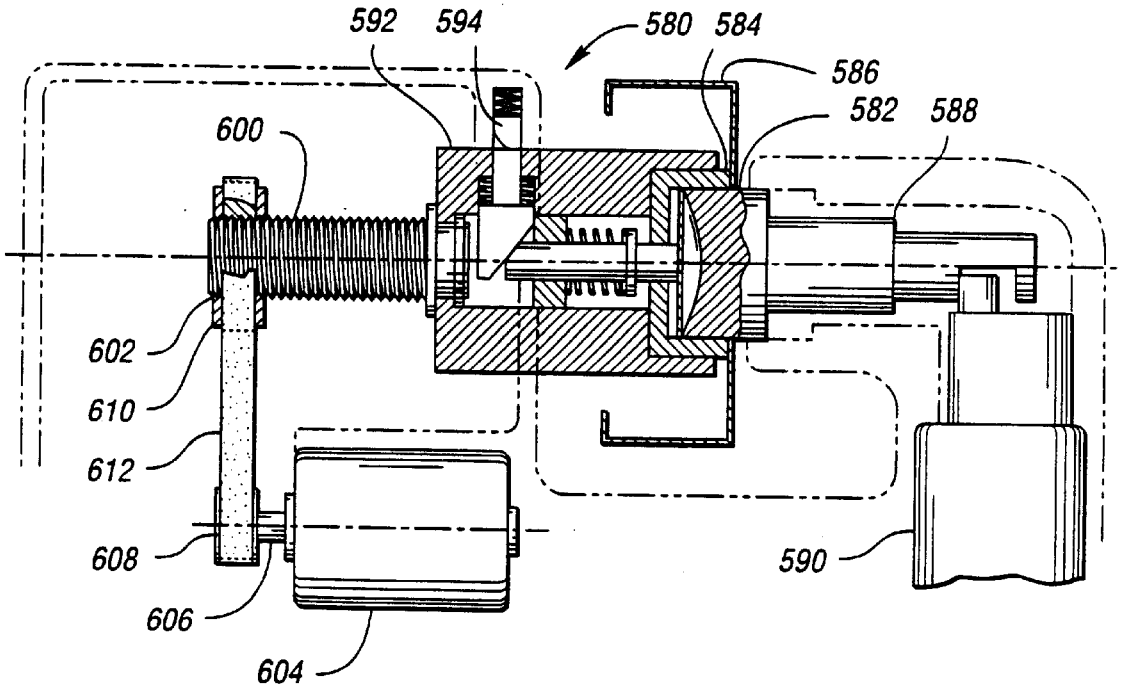

With reference to FIGS. 10*a*–10*c,* yet another alternative apparatus of the present invention is generally indicated at 580. Apparatus 580 has a punch 582 and a die 584 for punching pieces of stud 586. Further, apparatus 580 employs a reciprocating member 588, and a driving mechanism 590. Die 584 is held by die support member 592. Die support member 592, similar to those embodiments described previously, may be locked by lock member 594 and locking mechanism 596 into the closed position. In this embodiment, die support member 592 has a threaded member 600. A nut 602 is received on threaded member 600. Nut 602 is mounted for rotation within the C-shaped frame portion while remaining axially stationary with respect to the C-shaped frame portion.

A driving mechanism 604 has a drive shaft 606 that drives a pulley 608. A second pulley 610 is defined by nut 602, and a drive belt 612 transfers motion of drive shaft 606 to nut 602. Rotation of nut 602 in a first direction causes die 584 to move toward the closed position. Rotation of nut 602 in a second direction causes die 584 to move toward the open position. Of course, alternatively, other mechanisms may be employed to impart the driving motion of drive shaft 606 to nut 602, such as gears.

Figures 11, 12:
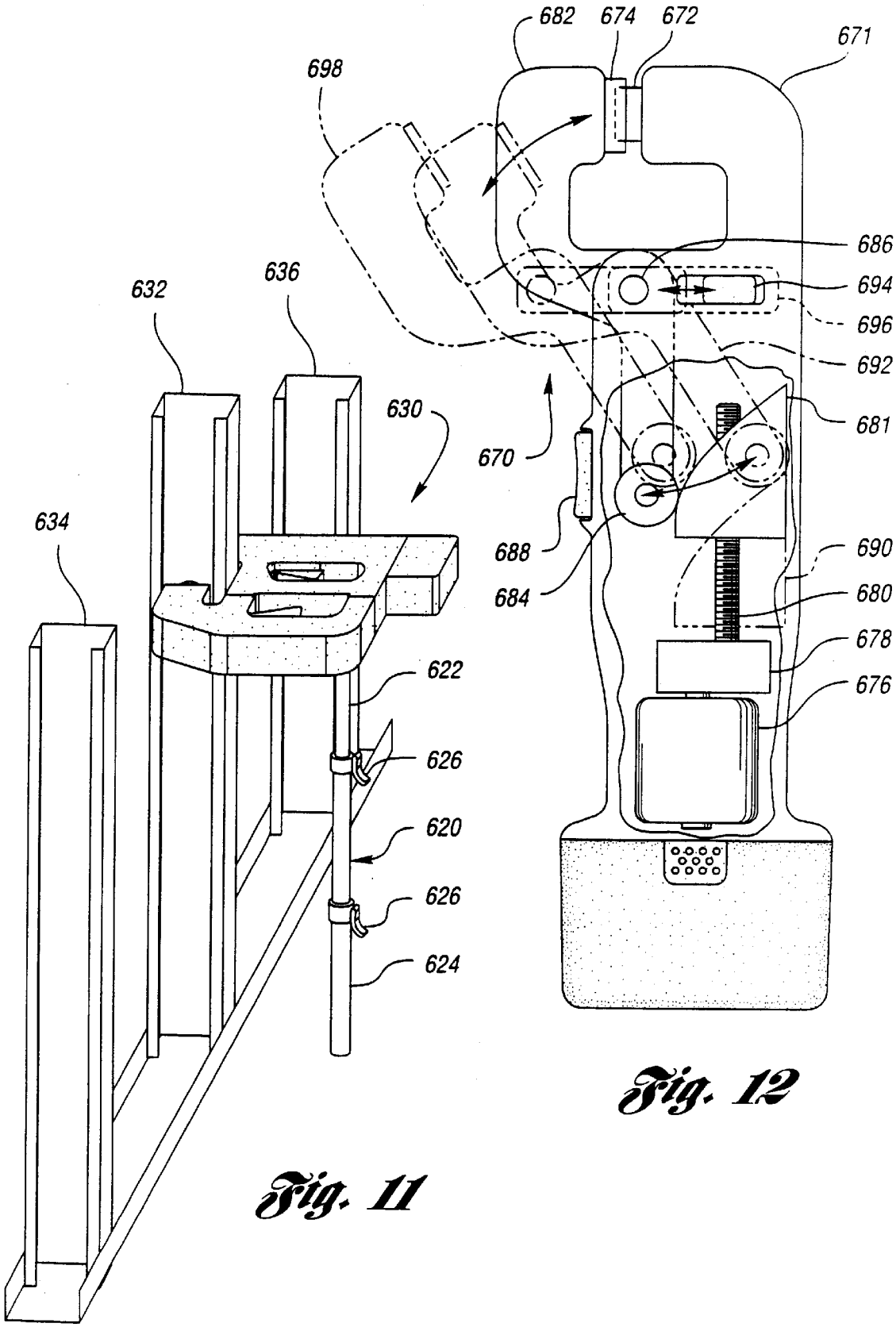
FIG. 11 illustrates a detachable leg of the present invention for use with a punching apparatus.
FIG. 12 is yet another alternative embodiment of an apparatus of the present invention for punching steel studs.

With reference to FIG. 11, a measuring device for use with a punching apparatus in accordance with the present invention is generally indicated at 620. Device 620 is a detachable telescopic leg. Telescopic leg 620 may be formed, for example, with an inner rod member 622 received within a sleeve member 624. Appropriately, lock members 626 are provided for locking member 622 with respect to sleeve 624 to fix the length of telescopic leg 620. Telescopic leg 620 may be connected to an apparatus 630 when punching a hole in a stud 632 by, for example, a threaded end on the leg that is received in a threaded aperture on the apparatus. As such, telescopic leg 620 may then be used to assure that holes punched into additional studs 634 and 636 will be at the same level as a hole punched into stud 632. As such, during construction, one may be assured that piping easily passes through the aligned holes. Of course, the leg may include a plurality of rod members that cooperate together, with a lock located at the interface of each adjacent pair of rod members.

With reference to FIG. 12, still another embodiment of the present invention is generally indicted at 670. Apparatus 670 includes a frame 671, a punch 672, and a die 674. Apparatus 670 is driven by a driving mechanism 676 connected through a gear reduction mechanism 678 to drive a threaded member 680. Threaded member 680 drives a cam mechanism 681 that has threads on its inside such that rotation of threaded member 680 in a first direction causes mechanism 681 to move upward, and such that rotation of threaded member 680 in the other direction causes mechanism 681 to move downward. Frame member 682 has a roller 684 connected thereto. Roller 684 rides on cam mecahnism 681 to pivot frame member 682 about pivot connection 686. Frame member 682 is pivoted such that punch 672 engages die 674 to punch through the stud and produce a knock-out. In the other direction, frame member 682 pivots to open sufficiently to allow a stud to be positioned between punch 672 and die 674. The fully opened position for frame member 682 is indicated in phantom at 692, with the corresponding fully retracted position of the cam mechanism indicated in phantom at 690. In a preferred embodiment, a release mechanism may be operated by sliding switch 694 to allow frame member 682 to be further slid away from punch 672 to allow an even wider opening to position back to back studs therebetween, as shown in phantom at 698. Sliding switch 694 releases slide bar 696 to allow sliding of frame member 682. As shown, driving mechanism 676 may be operated to turn in either direction by lever switch 688.

Figure 13:
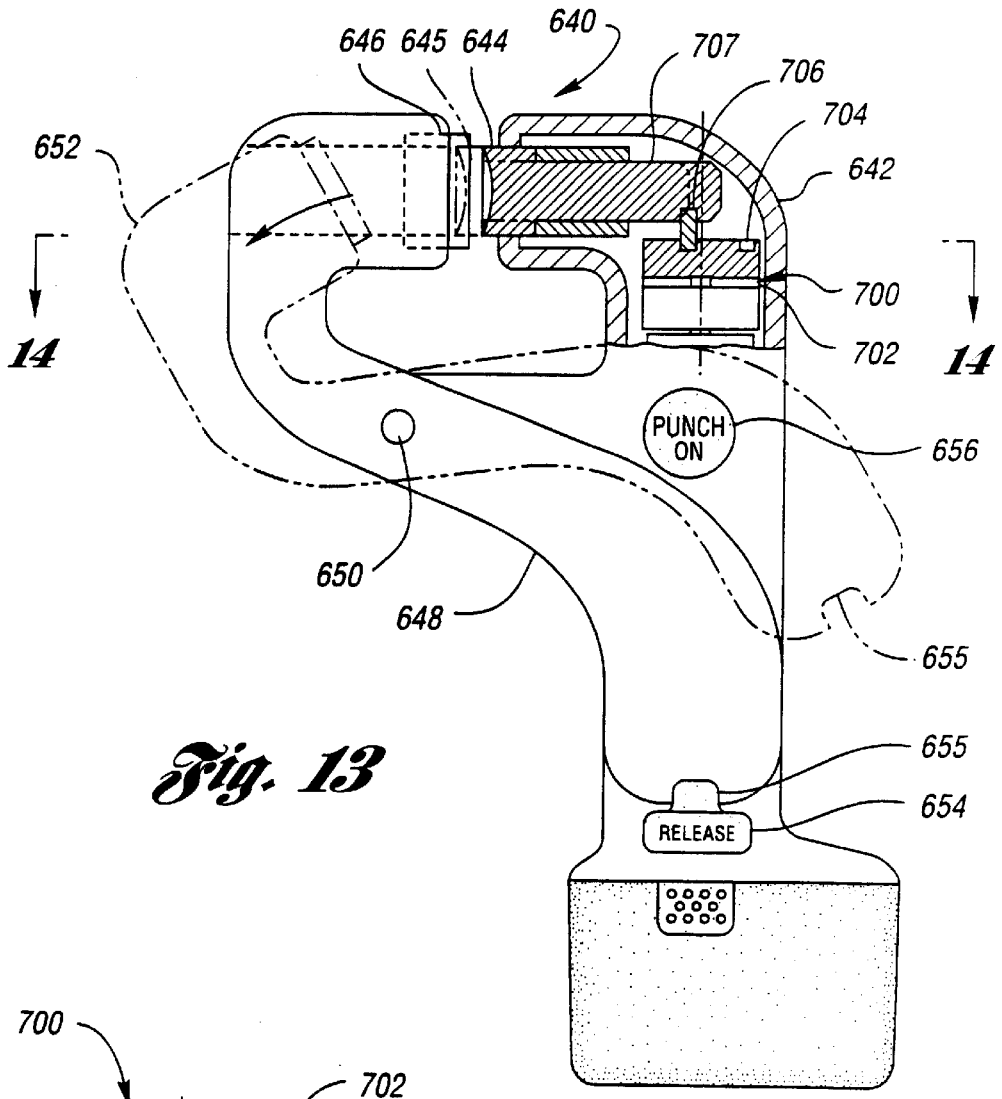
FIG. 13 is still another alternative embodiment of the present invention for punching steel studs, utilizing a slotted cam plate.

With reference to FIG. 13, yet another embodiment of the present invention is generally indicated at 640. Apparatus 640 includes a generally C-shaped compact hand-held frame 642, with a punch 644 (having an actuated position shown in phantom at 645) and a die 646 at ends of the C-shaped portion. A gross adjust mechanism is composed of frame member 648 which is employed to allow movement of die 646 into and out of a working or closed position. Frame member 648 pivots about pivotal attachment 650 between a closed position, shown at 648, and an open position shown in phantom at 652. Advantageously, the closed position 648 for the member is configured such that member 648 engages lockable release mechanism 654 into slot 655. Mechanism 654 may be in the form of push button that is depressed to unlock member 648 after a punching operation is complete, to push the tap out of slot 655. Mechanism 654 preferably automatically locks when member 648 is pivoted to the closed position. Preferably, push button 656 causes a driving mechanism 700 to cause punch 644 to drive through a stud into die 646. In a preferred embodiment, push button 656 is covered when the pivotable frame member is pivoted to the open position, indicated in phantom at 652.

Figure 14:
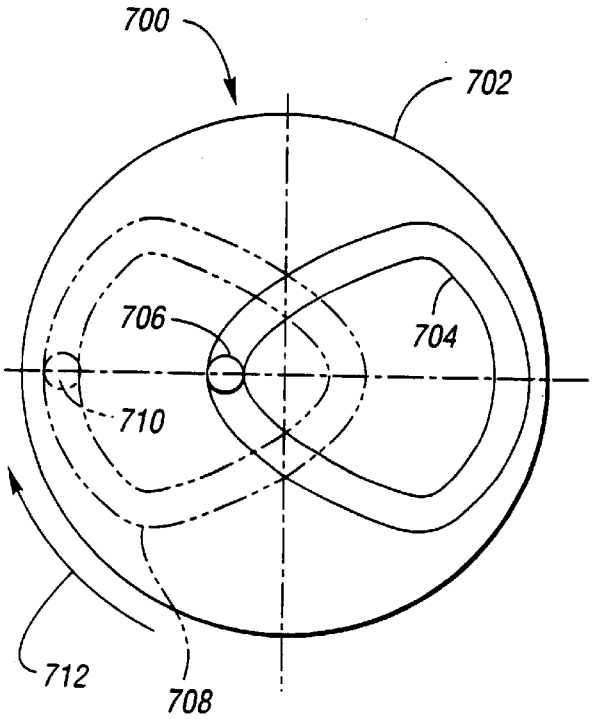
FIG. 14 is an enlarged view of the cam plate on the apparatus shown in FIG. 13.

Driving mechanism 700 is a motor (or turbine) connected through a gear reduction mechanism to a cam plate 702. As best shown in FIG. 14, cam plate 702 includes a slot 704. Upon driving of the motor or turbine, the gear reduction assembly drives cam plate 702 to rotate plate 702 as indicated by arrow 712. A pin 706 is affixed to punch holder 707 and engages slot 704. As cam plate 702 rotates, the rotational movement of cam plate 702 is converted into linear movement of pin 706, causing punch 644 to reciprocate.

As best shown in FIG. 14, when punch 644 is fully retracted, the slot in cam plate 702 is at position 704, with the pin attached to punch holder 707 in position 706. Upon rotation of cam plate 702 as indicated by arrow 712, the punch moves to the extended position shown in phantom at 645 (FIG. 13). When the punch is extended, the slot on cam plate 702 is in the position shown in phantom at 708, with the pin in position 710, also shown in phantom.

It is to be appreciated that the slot causes the punch to have a lower velocity and resultingly more mechanical advantage near the fully extended position, while moving the punch at greater velocity over the gross adjust range or non-working portion of the stroke. Of course, it is to be appreciated that although the slot is shown in a preferred shape, other shapes for the slot are appreciated by those of ordinary skill in the art. For example, a circular slot may be used in the alternative.

Figure 15:
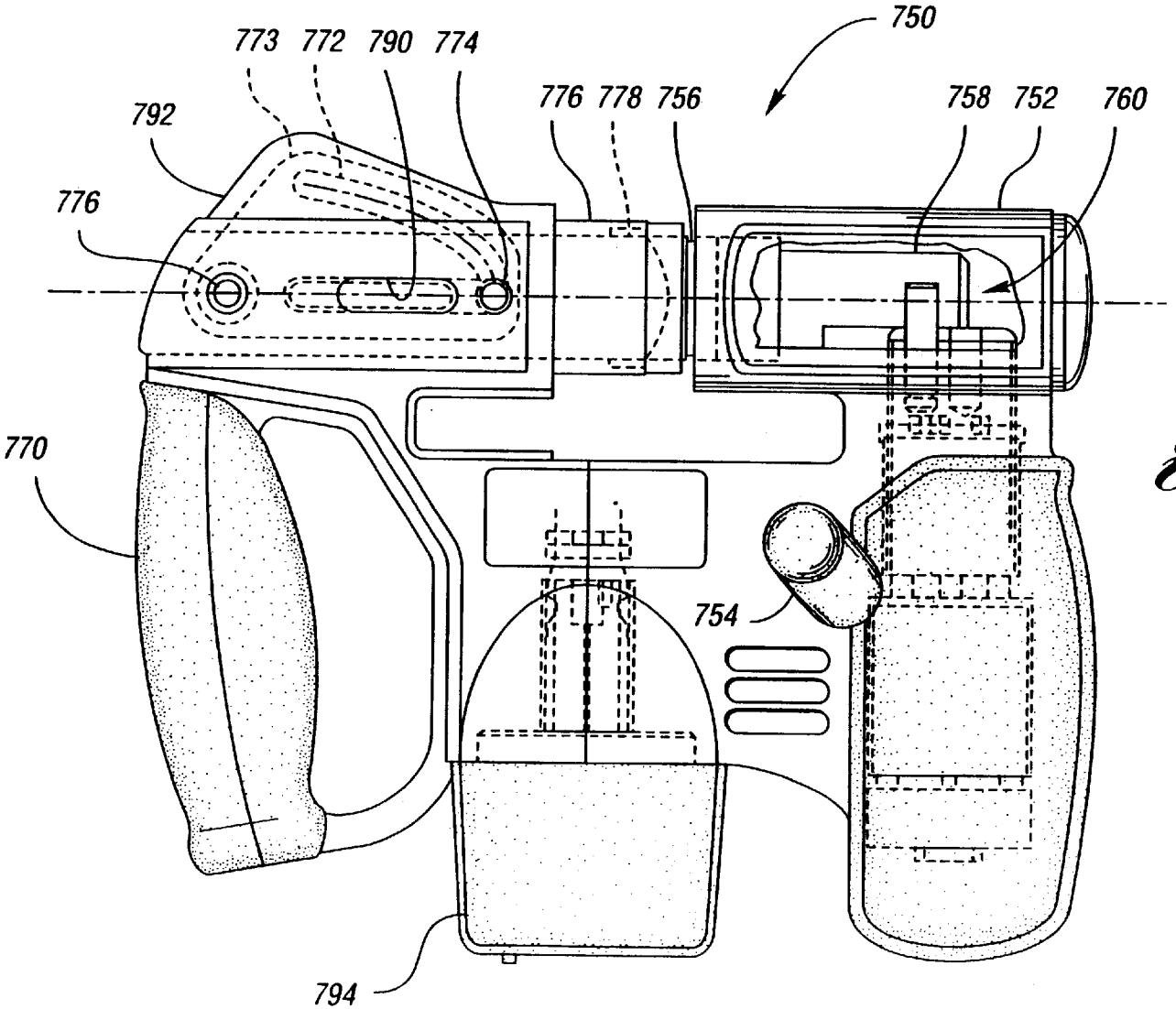
FIG. 15 is yet another embodiment of the present invention, similar to that shown in FIG. 4.

FIGS. 15 and 16 illustrate another alternative of the present invention. A steel stud punch is generally indicated at 750. Apparatus 750 includes frame 752 having handle 754, with punch 756 held in punch holder 758 which is driven by driving mechanism 760. The other side of the frame includes a handle 770 with a slot 772 on plate 773 which is fixed to handle 770. A pin 774 on die holder 776 cooperates with slot 772 to provide a gross adjust mechanism for die 778.

Preferably, and as best shown in FIG. 16, frame 752 includes a slot 790 that cooperates with slot 772 and pin 774. As handle 770 is pivoted about pin 796, pin 774 slides through slots 790 and 772 to move die 778.

Figure 17:
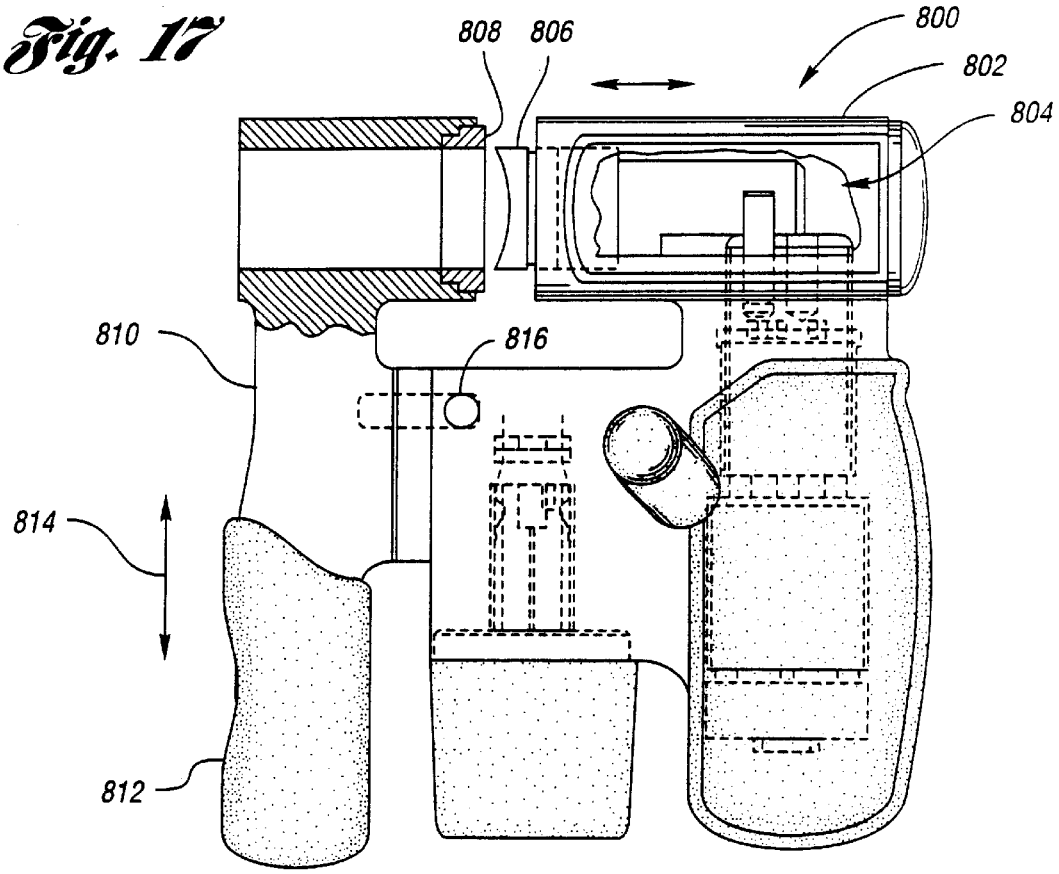
FIG. 17 is another embodiment of the present invention, utilizing a sliding adjustment mechanism.

With reference to FIG. 17, yet another alternative embodiment of a punching apparatus of the present invention is generally indicated at 800. Apparatus 800 includes frame 802 enclosing driving mechanism 804 for driving punch 806 into die 808. In this embodiment, a frame member 810 supports die 808, and has a handle 812. Member 810 is mounted for sliding movement with respect to frame member 802, as indicated by arrow 814. A lock mechanism 816 is used to secure member 810 in a working position with die 808 aligned with punch 806. In use, a user slides member 810 out of the way to allow positioning of a workpiece adjacent punch 806, and then slides member 810 to place die 808 in the working position.

Figure 18:
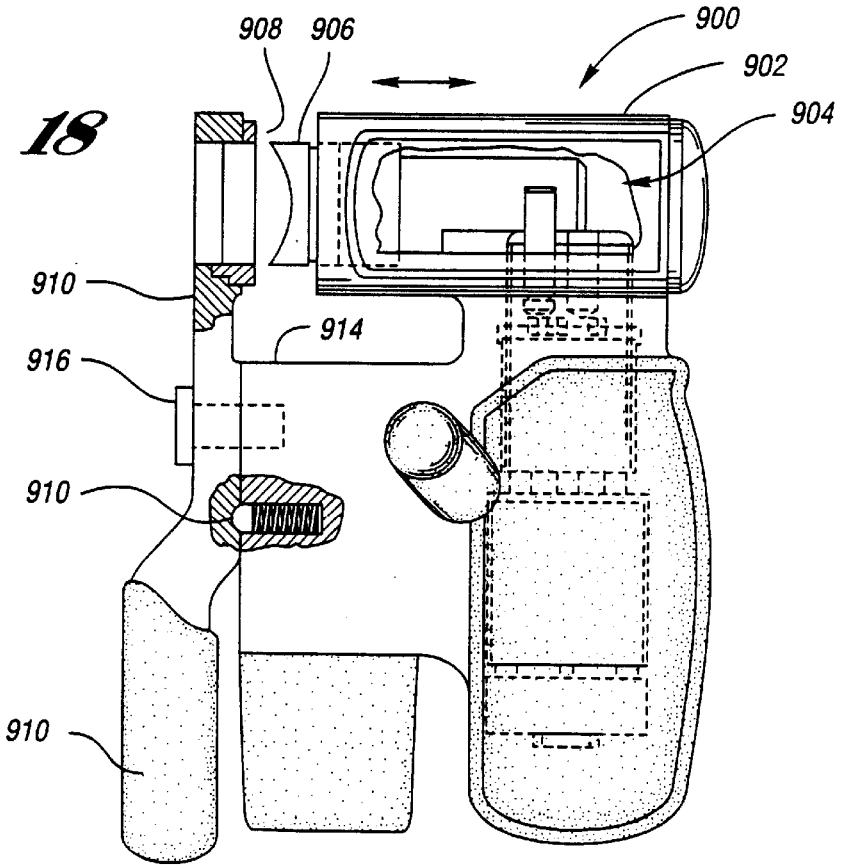
FIG. 18 is still another embodiment of the present invention, utilizing a pivotal adjustment mechanism.

With reference to FIG. 18, yet another embodiment of the present invention is generally indicated at 900. Apparatus 900 includes frame 902 enclosing driving mechanism 904. Mechanism 904 drives punch 906 into die 908. Die 908 is held in a frame member 910 with a handle 912. Frame member 910 is pivotally attached to frame portion 914 by a pivot pin 916. Somewhat similar to the apparatus shown in FIG. 17, apparatus 900 of FIG. 18 provides a gross adjust mechanism by utilizing pivotal movement of member 910 to move die 908 away from punch 906 to allow positioning of a workpiece therebetween. Preferably, a suitable locking mechanism such as ball and detent mechanism 918 is provided to lock rod member 910 in a working position prior to punching through the workpiece.

While the best mode for carrying out the invention has been described in detail, those familiar with the art to which this invention relates will recognize various alternative designs and embodiments for practicing the invention as defined by the following claims.

What is claimed is:

1. An apparatus for punching knock-outs out of light gauge steel framing studs used in building construction to form holes of sufficient size to allow building wiring and piping to extend therethrough, the apparatus comprising:

a compact hand held frame having frame having a generally C-shaped portion with sufficiently spaced apart ends located along a working axis for receiving a light gauge steel framing stud used in building construction therebetween, and a handle for gripping by a user;

a punch and die assembly including a punch and a die mounted opposite each other at the ends of the C-shaped frame portion, the punch and the die being mounted for movement relative to each other along the working axis, the die having a body defining a cavity, and the punch being configured with respect to the cavity such that punching a hole produces a knock-out wherein the punch and the die are sized and configured to produce the knock-out and form the hole in the stud with the hole having sufficient size to allow building wiring and piping to extend therethrough; and an actuatable driving mechanism mounted to the frame and operable to drive the punch and die assembly over a working stroke range between a deactuated position in which the punch and the die are spaced apart with the stud positioned therebetween, and an actuated position in which the punch extends into the die cavity by punching through the stud to form the punched hole.

2. The apparatus of claim 1 wherein the driving mechanism further comprises:

an electric motor mounted to the frame and having a drive shaft;

a gear reduction assembly having an input portion driven by the drive shaft, and an output portion; and a cam mechanism driven by the output portion of the gear reduction assembly, the cam mechanism driving the punch and die assembly over the working stroke range.

3. The apparatus of claim 1 wherein the driving mechanism further comprises:

a turbine mounted to the frame and having an input for connection to a fluid source, and a drive shaft;

a gear reduction assembly having an input portion driven by the drive shaft, and an output portion; and a cam mechanism driven by the output portion of the gear reduction assembly, the cam mechanism driving the punch and die assembly over the working stroke range.

4. The apparatus of claim 1 wherein the working stroke range is not significantly larger than that required to punch through the stud, and the apparatus further comprises:

a gross adjust mechanism configured for moving the punch and the die relative to each other over a gross adjust stroke range significantly larger than that required to punch through the stud between an open position allowing the positioning of the stud between the punch and the die, and a closed position based on the working stroke range to cause punching of the punch through the stud upon actuation of the driving mechanism.

5. The apparatus of claim 4 wherein the C-shaped frame portion includes first and second halves, each half including a respective end of the C-shaped frame portion, and the gross stroke range being defined along the working axis, wherein the gross adjust mechanism further comprises:

a lockable slide member connecting the first and second halves of the C-shaped frame portion and allowing sliding movement of the die toward and away from the punch along the working axis by moving the slide member; and a lock device for unlocking the slide member to allow movement of the slide member, and for locking the slide member to prevent movement of the slide member during actuation of the driving mechanism.

6. The apparatus of claim 4 wherein at least one end of the C-shaped frame portion includes an undercut portion to allow positioning of differently shaped studs between the punch and the die.

7. The apparatus of claim 6 wherein both ends of the C-shaped frame portion include undercut portions to allow positioning of differently shaped studs between the punch and the die.

8. The apparatus of claim 4 wherein the gross adjust stroke range is defined along the working axis, and wherein the gross adjust mechanism further comprises:

a shaft oriented along the working axis and having first and second ends, the punch being mounted to the shaft first end, and the shaft slidably cooperating with the frame to move the punch relative to the die over the gross adjust stroke range between the open and closed positions; and wherein the driving mechanism further comprises:

a lever pivotally attached to the frame and having a grip portion proximate the handle enabling the user to squeeze the handle and the lever together;

an advance sear cooperating with the shaft and the lever to cause the shaft to incrementally advance the punch toward the die each time the lever grip portion is squeezed toward the handle; and a retract sear cooperating with the shaft and the frame to enable the shaft to freely advance while preventing the shaft from retracting after each incremental advance.

9. The apparatus of claim 4 wherein the gross adjust stroke range is defined along the working axis, and wherein the gross adjust mechanism further comprises:

a die support member slidably received in the die end of the C-shaped frame portion, the die being received in the die support member;

a pin extending outwardly from a periphery of the die support member; and a lever pivotally attached to the die end of the C-shaped frame portion, the lever having an arcuate slot which receives the pin therein to guide the die relative to the punch over the gross adjust stroke range between the open and closed positions as the lever is pivoted, wherein the slot is configured at one end such that the punch and die cavity are secured in the closed position when the lever is positioned to position the pin in the inflection of the slot.

10. An apparatus for punching knock-outs out of light gauge steel framing studs used in building construction to form holes of sufficient size to allow building wiring and piping to extend therethrough, the apparatus comprising:

a compact hand held frame having a generally C-shaped portion with sufficiently spaced apart ends located along a working axis for receiving a light gauge steel framing stud used in building construction therebetween, and a handle for gripping by a user;

a punch and die assembly including a punch and a die mounted opposite each other at the ends of the C-shaped portion of the frame, the punch and the die being mounted for movement relative to each other along the working axis the die having a body defining a cavity, and the punch being configured with respect to the cavity such that punching a hole produces a knock-out wherein the punch and the die are sized and configured to produce the knock-out and form the hole in the stud with the hole having sufficient size to allow building wiring and piping to extend therethrough;

an electric motor mounted to the frame and having a drive shaft;

a gear reduction assembly having an input portion driven by the drive shaft, and an output portion;

a cam mechanism driven by the output portion of the gear reduction assembly, the cam mechanism driving the punch and die assembly over a working stroke range between a deactuated position in which the punch and the die are spaced apart with the stud positioned therebetween, and an actuated position in which the punch extends into the die cavity by punching through the stud to form the punched hole; and a gross adjust mechanism configured for moving the punch and the die relative to each other over a gross adjust stroke range significantly larger than that required to punch through the stud between an open position allowing the positioning of the stud between the punch and the die, and a closed position based on the working stroke range to cause punching of the punch through the stud upon actuation of the driving mechanism.

11. The apparatus of claim 10 wherein at least one end of the C-shaped frame portion includes an undercut portion to allow positioning of differently shaped studs between the punch and the die.

12. The apparatus of claim 10 wherein the electric motor is powered by a battery source.

13. An apparatus for punching knock-outs out of light gauge steel framing studs used in building construction to form holes of sufficient size to allow building wiring and piping to extend therethrough, the apparatus comprising:

a compact hand held frame having a generally C-shaped portion with sufficiently spaced apart ends located along a working axis for receiving a light gauge steel framing stud used in building construction therebetween, and a handle for gripping by a user;

a punch and die assembly including a punch and a die mounted opposite each other at the ends of the C-shaped frame portion, the punch and the die being mounted for movement relative to each other along the working axis the die having a body defining a cavity, and the punch being configured with respect to the cavity such that punching a hole produces a knock-out wherein the punch and the die are sized and configured to produce the knock-out and form the hole in the stud with the hole having sufficient size to allow building wiring and piping to extend therethrough, wherein the die body defines an opening in communication with the cavity, the opening being sized such that the knock-out exits the die cavity by passing through the opening; and an actuatable driving mechanism mounted to the frame and operable to drive the punch and die assembly over a working stroke range between a deactuated position in which the punch and the die are spaced apart with the stud positioned therebetween, and an actuated position in which the punch extends into the die cavity by punching through the stud to allow the knock-out to exit the die cavity by passing through the opening.

14. The apparatus of claim 13 wherein the die body is rotatably mounted to the C-shaped frame portion such that rotation of the die allows a user to selectively position the opening with respect to the C-shaped frame portion.

15. The apparatus of claim 14 further comprising:

a lock mechanism configured with respect to the die body and the C-shaped frame portion such that the die body may be selectively rotated to a desired position with respect to the C-shaped frame portion, and locked in the desired position by the lock mechanism.

16. The apparatus of claim 15 wherein the lock mechanism comprises:

a ball and detent mechanism providing a plurality of locked positions for the die body with respect to the C-shaped frame portion.

17. The apparatus of claim 13 further comprising:

a sleeve encircling the punch, and slidingly engaging the punch; and a spring biasing the sleeve toward the die such that upon actuation of the driving mechanism, the sleeve engages the die body prior to the punching out of the knock-out.

18. The apparatus of claim 4 wherein the gross adjust mechanism comprises:

a die support member slidably received in the die end of the C-shaped frame portion and holding the die, the die support member including a spring seat;

a spring biasing the die support member at the spring seat so as to urge the die toward the open position; and an electromagnet operative to urge the die support member against the bias of the spring so as to move the die to the closed position under actuation of the electromagnet.

19. The apparatus of claim 4 wherein the gross adjust mechanism comprises:

a die support member slidably received in the die end of the C-shaped frame portion and holding the die, the die support member including an angled cam surface;

a die driving mechanism having a rotatable drive shaft with an end having a pinion; and a rack member engaging the pinion, the rack member having an end with a complimentary angled cam surface that engages the die support member can surface, the rack member and pinion being arranged such that rotation of the drive shaft in a first direction causes the rack member cam surface to slide against the die support member cam surface to move the die to the closed position, and such that rotation of the drive shaft in a second direction allows the die to retreat to the open position.

20. The apparatus of claim 4 wherein the gross adjust mechanism further comprises:

a die support member slidably received in the die end of the C-shaped frame portion and holding the die;

a trigger at the handle; and a pulley arrangement configured to extend from an area proximate the trigger to an attachment point on the die support member, the pulley arrangement being configured such that squeezing the trigger urges the die support member to cause the die to move to one of the open and closed positions; and a spring biasing the die support member to cause the die to move to an other of the open and closed positions when the trigger is not being squeezed.

21. The apparatus of claim 20 wherein the pulley arrangement is configured such that squeezing the trigger causes the die to move to the closed position.

22. The apparatus of claim 4 wherein the gross adjust mechanism comprises:

a die support member slidably received in the die end of the C-shaped frame portioin and holding the die, the die support member including a threaded member;

a die driving mechanism having a rotatable drive shaft; and a nut received on the threaded member, the nut being mounted for rotation within the C-shaped frame portion while remaining axially stationary with respect to the C-shaped frame portion such that rotation of the nut in a first direction causes the die to move toward the closed position, and such that rotation of the nut in a second direction causes the die to move toward the open positioin, wherein the nut is in driving engagement with the die driving mechanism rotatable drive shaft.

23. The apparatus of claim 22 further comprising:

a first pulley affixed to the end of the drive shaft;

a second pulley defined by the nut; and a drive belt positioned to transfer motion of the drive shaft to the nut.

24. The apparatus of claim 4 wherein the gross adjust mechanism comprises:

a die support member slidably received in the die end of the C-shaped frame portion and holding the die;

a rod member extending along the die support member, the rod member having an end protruding into the die cavity; and a lock mechanism at an other end of the rod member, the lock mechanism being configured such that when locked, the knock-out is pressed into the die cavity by the punch to resultantly push the end of the rod member causing the lock mechanism to disengage.

* * * * *

UNITED STATES PATENT AND TRADEMARK OFFICE

CERTIFICATE OF CORRECTION

PATENT NO. : 6,367,362 B1
DATED : April 9, 2002
INVENTOR(S) : Kenneth M. Brazell et al.

It is certified that error appears in the above-identified patent and that said Letters Patent is hereby corrected as shown below:

Column 16,
Line 43, "the lever is positioned to position" should be -- the lever is pivoted to position. --

Column 18,
Line 33, "can surface" should be -- cam surface. --
Line 62, "portioin" should be -- portion. --

Signed and Sealed this

Twenty-fourth Day of September, 2002

*Attest:*

*Attesting Officer*

JAMES E. ROGAN
*Director of the United States Patent and Trademark Office*